US012479064B2

(12) United States Patent
Kawamura et al.

(10) Patent No.: US 12,479,064 B2
(45) Date of Patent: Nov. 25, 2025

(54) POLISHING PAD

(71) Applicant: FUJIBO HOLDINGS, INC., Tokyo (JP)

(72) Inventors: Yoshihide Kawamura, Saijo (JP); Teppei Tateno, Saijo (JP); Ryuma Matsuoka, Saijo (JP); Hiroshi Kurihara, Saijo (JP); Satsuki Narushima, Saijo (JP); Yamato Takamizawa, Saijo (JP); Keisuke Ochi, Saijo (JP); Tetsuaki Kawasaki, Saijo (JP)

(73) Assignee: FUJIBO HOLDINGS, INC., Tokyo (JP)

( * ) Notice: Subject to any disclaimer, the term of this patent is extended or adjusted under 35 U.S.C. 154(b) by 384 days.

(21) Appl. No.: 18/246,608

(22) PCT Filed: Sep. 29, 2021

(86) PCT No.: PCT/JP2021/035824
§ 371 (c)(1),
(2) Date: Mar. 24, 2023

(87) PCT Pub. No.: WO2022/071383
PCT Pub. Date: Apr. 7, 2022

(65) Prior Publication Data

US 2023/0364736 A1 Nov. 16, 2023

(30) Foreign Application Priority Data

Sep. 30, 2020 (JP) ..... 2020-165757

(51) Int. Cl.
*B24B 37/24* (2012.01)
*B24B 37/22* (2012.01)

(52) U.S. Cl.
CPC ..... *B24B 37/24* (2013.01); *B24B 37/22* (2013.01)

(58) Field of Classification Search
CPC ..... B24B 37/24; B24B 37/22; B24B 37/20; B24B 37/26
See application file for complete search history.

(56) References Cited

U.S. PATENT DOCUMENTS

2019/0168356 A1* 6/2019 Qian ..... B24B 37/044

FOREIGN PATENT DOCUMENTS

CN 101238178 A * 8/2008 ..... C08L 61/28
JP 2004-507076 A 3/2004
(Continued)

OTHER PUBLICATIONS

International Search Report dated Dec. 14, 2021 for the corresponding patent application No. PCT/JP2021/035824, with English translation.

*Primary Examiner* — Joel D Crandall
(74) *Attorney, Agent, or Firm* — LUCAS & MERCANTI, LLP

(57) ABSTRACT

A polishing pad contains: a polishing layer having a polishing surface for polishing a workpiece; and a cushion layer disposed on the side of the polishing layer opposite from the polishing surface. With regard to the ratio (tan δ) of the storage elastic modulus E' to the loss elastic modulus E" of the whole polishing pad, as obtained through dynamic viscoelasticity measurement using frequency dispersion (25° C.) in a bending mode, the ratio of the maximum value of tan δ measured at 100-1000 rad/s (tan $\delta_{max100\text{-}1000}$) to the maximum value of tan δ measured at 1 to 10 rad/s (tan $\delta_{max1\text{-}10}$) is 0.75 to 1.30.

9 Claims, 20 Drawing Sheets

(56) References Cited

FOREIGN PATENT DOCUMENTS

| | | | | | |
|---|---|---|---|---|---|
| JP | 2012-714 | A | | 6/2010 | |
| JP | 2016-190313 | A | | 11/2016 | |
| JP | 2018-43342 | A | | 3/2018 | |
| JP | 6600149 | B2 | | 10/2019 | |
| JP | 2020-104214 | A | | 7/2020 | |
| WO | WO-0246283 | A1 | * | 6/2002 | ..... H01L 21/304 |
| WO | WO-2019188577 | A1 | * | 10/2019 | ..... H01L 21/304 |

* cited by examiner (a)

(b)

POLISHING PAD

CROSS REFERENCE TO RELATED APPLICATION

This Application is a 371 of PCT/JP2021/035824 filed on Sep. 29, 2021 which, in turn, claimed the priority of Japanese Patent Application No. 2020-165757 filed on Sep. 30, 2020, all of which are incorporated herein by reference.

TECHNICAL FIELD

The present invention relates to a polishing pad. The present invention relates to a polishing pad suitably used for polishing the optical material, the semiconductor wafer, the semiconductor device, the substrate for the hard disk and the like in detail.

BACKGROUND ART

A chemical mechanical polishing (CMP) method is generally used for polishing to flatten the surface of an optical material, a semiconductor wafer, a semiconductor device and a substrate for hard disk.

The CMP method is described with FIG. 1. As shown in FIG. 1, the polishing apparatus 1 performing the CMP method is provided with the polishing pad 3. The polishing pad 3 abuts the workpiece 8 held by holding the surface plate 16 and the retainer ring (not illustrated in FIG. 1) holding the workpiece 8 so as not to be misaligned. The polishing pad 3 comprises the polishing layer 4 polishing the workpiece 8 and the cushioning layer 6 supporting the polishing layer 4. The polishing pad 3 is rotatively driven to polish the workpiece 8 with press. At that time, the slurry 9 is supplied between the polishing pad 3 and the workpiece 8. The slurry 9 is a mixture (dispersion liquid) of the water, the various chemical components and the hard fine abrasive grain and enhances the polishing effect by the relative motion to the workpiece 8, while the chemical components and the abrasive grain thereof are drained. The slurry 9 is supplied to the polishing surface and discharged through the grooves or the holes.

As the polishing pad 3 described above, the polishing pad using the foamed polyurethane for the polishing layer 4 has been used. During polishing, the polishing layer 4 follows the shape of the edge of the workpiece 8, and as shown in FIG. 2, the excessive polishing phenomenon referred to as "edge sagging" (8*a* in FIG. 2) that the edge of the workpiece 8 is polished larger than the central part is generated. From FIG. 3 in which the vertical line shows the removal rate (R. R.) and the horizontal line shows the distance on the strait line passing through the center of the workpiece 8 ("0" on the horizontal line shows the center of the workpiece 8), it is observed that the removal rates at the both end parts are larger than the removal rates at the other parts, and edge sagging is generated. Edge sagging may be undesirable in polishing the semiconductor (particularly in the polishing process of the oxide film), the especially when the removal rate of the endmost part (the inner peripheral part) of the workpiece is 1.5 or more times of the removal rate of the other part.

In regard to the excessive polishing phenomenon referred to as edge sagging, Patent Document 1 discloses a polishing pad having a specific bubble structure in the foam to keep the hardness of the polishing layer within a certain range and to prevent not only the edge sagging but also the generation of the polishing flaw.

Patent Document 2 discloses a polishing pad that the hardness and the tear strength of the polishing layer are kept within a prescribed range and thereby edge sagging is not generated.

The polishing pad obtained by using the foamed polyurethane for the polishing layer is generally used as a polishing pad for the CMP method. Recently, the microfabrication of the wiring of the semiconductor device is made to progress and the improvement of the flattening of the wafer with the pattern and the like as well as the step elimination performance is required.

For example, Patent Document 3 disclose a polishing pad exhibiting reduction of the dishing of the metal feature, excellent flattening performance and a low degree of the occurrence of the defect by especially dissipating the high energy during compressing as well as having high rigidity, which can be obtained by keeping the storage elastic modulus (E') measured in the DMA and the like of the polishing layer within a certain range.

Patent Document 4 discloses a polishing pad providing high efficiency of flattening and low defect occurrence rate into reality by using the mixture of PPG and PTMG as polyol having high-molecular weight used for the prepolymer used as the material for the polishing layer.

CITATION LIST

Patent Document

Patent Document 1: JP 2012-714 A
Patent Document 2: JP 2016-190313 A
Patent Document 3: JP 2004-507076 A
Patent Document 4: JP 2018-43342 A

SUMMARY OF INVENTION

Technical Problem

The polishing pads described in Patent Documents 1 and 2 described above are required to have the polishing layer having specific physical properties and certain bubble structures. In some cases, the polishing pad may be inferior in the other polishing performance, even if edge sagging is improved.

When the polishing pad described in Patent Document 3 is examined, the polishing pad is not sufficient in the step eliminate performance. The causes of results would be that the characteristics of the only polishing layer measured in the DMA is focused and the characteristics is measured at the only frequency at the central part of the polishing pad of 10 rad/s. The material for polishing pad described in Patent Document 4 is obtained by blending PTMG (polytetramethyleneehterglycol) conventionally used as the material for the polishing pad with PPG (polypropyleneglycol). By adding PPG, the structure of the soft segment of polyurethane of the polishing layer changes and thus the physical properties such as the hardness change. Consequently, in some cases, the other polishing characteristics may be insufficient.

The present invention has been made in view of the above problems, one of the objects thereof is to provide a polishing pad enabling an improvement in edge sagging without greatly changing the physical properties/bubble structure of the polishing layer and furthermore improving the step elimination performance without greatly changing the composition/physical properties and the like of the polishing layer.

Solution to Problem

The present inventors made intensive studies in order to solve the above problems and as a result, and found that the above problems can be solved by using a polishing pad that prevents edge sagging and/or improves the step elimination performance.

That is, the present invention involves the followings:

[1]. A polishing pad comprising a polishing layer having a polishing surface for polishing a workpiece and a cushioning layer disposed on the opposite side of the polishing layer from the polishing surface, wherein with regard to a ratio (tan δ) of a storage elastic modulus E' to a loss elastic modulus E" of a whole polishing pad as obtained through a dynamic viscoelasticity measurement using a frequency dispersion (25° C.) in a bending mode, a ratio of a maximum value of tan δ measured at 100 to 1000 rad/s (tan $\delta_{max100\text{-}1000}$) to a maximum value of tan δ measured at 1 to 10 rad/s (tan $\delta_{max1\text{-}10}$) is 0.75 to 1.30.

[2] The polishing pad according to [1], wherein the ratio of the maximum value of tan δ measured at 100 to 1000 rad/s (tan $\delta_{max100\text{-}1000}$) to the maximum value of tan δ measured at 1 to 10 rad/s (tan $\delta_{max1\text{-}10}$) is 0.85 to 1.15.

[3] The polishing pad according to [1] or [2], wherein a ratio of a maximum value to a minimum value of tan δ measured at 0.1 to 10000 rad/s (the maximum value (tan $\delta_{max0.1\text{-}10000}$)/the minimum value (tan $\delta_{min0.1\text{-}10000}$)) is 1 to 1.3.

[4] The polishing pad according to any one of [1] to [3], wherein a difference between a maximum value and a minimum value of tan δ measured at 0.1 to 10000 rad/s (the maximum value (tan $\delta_{max0.1\text{-}10000}$)−the minimum value (tan $\delta_{min0.1\text{-}10000}$)) is 0 to 1.0.

[5] A polishing pad comprising a polishing layer having a polishing surface for polishing a workpiece and a cushioning layer disposed on the opposite side of the polishing layer from the polishing surface, wherein with regard to a storage elastic modulus E' when a dynamic viscoelasticity measurement of a whole polishing pad is performed using a frequency dispersion (25° C.) in a bending mode, a ratio of a value of E' measured at 1000 rad/s ($E'_{1000}$) to a value of E' measured at 10 rad/s ($E'_{10}$) ($E'_{1000}/E'_{10}$) is 1 to 2.

[6] The polishing pad according to [5], wherein the ratio of the value of E' measured at 1000 rad/s ($E'_{1000}$) to the value of E' measured at 10 rad/s ($E'_{10}$) ($E'_{1000}/E'_{10}$) is 1.4 to 1.9.

[7] The polishing pad according to [5] or [6], wherein the polishing layer is formed of a polyurethane resin containing hollow microspheres.

[8] The polishing pad according to any one of [5] to [7], wherein the cushion layer is at least one selected from a group consisting of an impregnated nonwoven fabric, a sponge material and a suede material.

[9] The polishing pad according to any one of [5] to [8], wherein in polishing a pattern wafer having a step, in an early stage of the polishing until a polishing amount of 2000 angstroms, a ratio of a step elimination amount (unit: angstroms) to a polishing amount (unit: angstroms) is more than 1, when the pattern wafer having a wiring width of 10 μm to 120 μm is polished.

Advantageous Effects of Invention

The polishing pad of the present invention can prevent edge sagging without changing the physical properties/bubble structure of the polishing layer by keeping tan δ which is the ratio of the storage elastic modulus E' to the loss elastic modulus E" within a certain range.

The polishing pad of the present invention can improve the step elimination performance without greatly changing the composition/physical properties and the like of the polishing layer by keeping a ratio of a value of E' measured at 1000 rad/s ($E'_{1000}$) to a value of E' measured at 10 rad/s ($E'_{10}$) ($E'_{1000}/E'_{10}$) of the whole polishing pad within a certain range.

FORM TO CARRY OUT INVENTION

Embodiments of the present invention are described below. The present invention is not limited to the embodiments.

<<Polishing Pad>>

Figure 4:
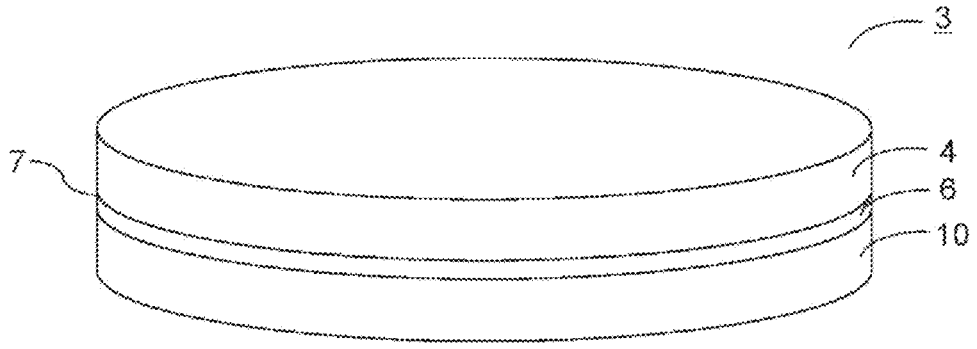
FIG. 4 is the perspective view (a) and the sectional view (b) of the polishing pad 3 of the present invention.
Figure 4:
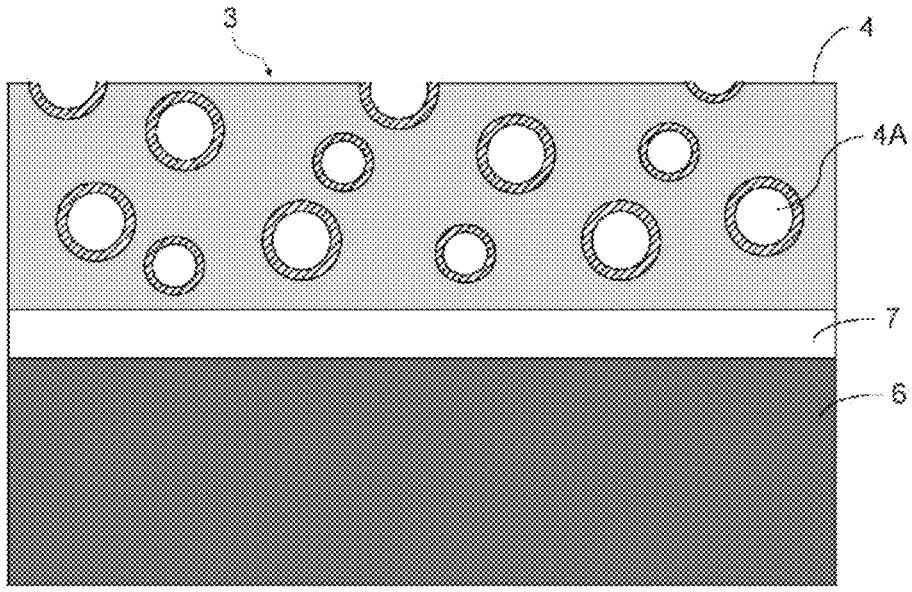

The structure of the polishing pad 3 is explained with reference to FIG. 4. As shown in FIG. 4, the polishing pad 3 includes the polishing layer 4 and the cushion layer 6. The shape of the polishing pad 3 is preferably a disc shape, but is not particularly limited. The size (the diameter) can be determined according to the size and the like of the polishing apparatus 1 provided with the polishing pad 3 and for example, can be about 10 cm to 2 m in diameter.

Note that as shown in FIG. 4 in the polishing pad 3 of the present invention, the polishing layer 4 is preferably adhered to the cushion layer 6 through the adhesive layer 7.

The polishing pad 3 is attached to the polishing surface plate 10 of the polishing apparatus 1 with a double-sided tape disposed on the cushion layer 6. The polishing pad 3 is rotatively driven to polish the workpiece 8 with the workpiece 8 pressed by the polishing apparatus 1.

<Polishing Layer>

(Structure)

The polishing pad 3 is provided with the polishing layer 4 which is a layer for polishing the workpiece 8. As materials for the polishing layer 4, polyurethane resin, polyurea resin and polyurethanepolyurea resin are preferably used and polyurethane resin is more preferably used.

The size (the diameter) of the polishing layer 4 is the same as the polishing pad 3 and can be about 10 cm to 2 m in diameter. The thickness of the polishing layer 4 can be generally about 1 to 5 mm.

The polishing layer 4 is rotated together with the polishing surface plate 10 of the polishing apparatus 1 and polishes the workpiece 8 by causing the relative motion of the chemical components and the abrasive grain of the slurry 9 together with workpiece 8 as the slurry 9 is allowed to flow thereon.

The hollow microspheres 4A (foamed) are distributed in the polishing layer 4.

(Grooving)

Grooving is preferably applied to the surface that is contacted with the workpiece 8 of the polishing layer 4 of the present invention. The grooves are not particularly limited. The polishing layer 4 may have either the slurry discharging grooves that are communicated with the circumference of the polishing layer 4 and the slurry holding grooves that are not communicated with the circumference of the polishing layer 4 and may have the both of the slurry discharging grooves and the slurry holding grooves. Examples of the slurry discharging grooves include the latticed grooves and the radical grooves. Examples of the holding grooves include the concentric grooves and the perforation (The through hole). The polishing layer 4 may have these grooves in combination.

In low pressure polishing, the surface plate is rotated at high speed in view of securing the removal rate to reduce the pressing force applied to the workpiece 8. Hence, the slurry 9 may be present in the form of a layer between the polishing surface and the surface to be processed to prevent polishing and what is called the hydroplane phenomenon may occur. The phenomenon can be prevented by applying grooving to the polishing surface. Grooving can promote the discharge of the polishing chips and the transfer of the polishing liquid. The cross-sectional shape of the groove may be any one of the U-shape, the V-shape and the semicircular shape. The pitch, the width and the depth of the groove are not particular limited. Surface griding such as buffing may be applied to the polishing surface and the surface opposite to the polishing surface of the polishing pad 3 to improve the flatness of the polishing pad 3.

(Shore D Hardness)

The shore D hardness of the polishing layer 4 of the present invention is not particularly limited, but for example, is 20 to 100, is preferably 30 to 80 and is more preferably 40 to 70. When the shore D hardness is low, the refine irregularity is hard to be flatten by low pressure polishing and in some cases edge sagging may be affected. When the shore D hardness is too high, the abrasive grain and the like are strongly rubbed against the workpiece 8 and thus the scratch may be generated on the surface to be processed of the workpiece 8.

The polishing layer 4 is formed by slicing the foam obtained by casting the solution obtained by mixing the mixture of the compound having isocyanate group and the hollow microspheres 4A described below with the curing agent (the chain extender) into the mold to be cured. Namely, the polishing layer 4 is molded in a dry state.

In the polishing pad 3 of the present invention, the bubbles are contained inside the polyurethane resin molded body by using the hollow microspheres 4A. The hollow microspheres 4A mean the microspheres having void inside. Examples of the shape of the hollow microspheres 4A include the spherical shape, the elliptical shape and the approximately spherical or elliptical shape. Examples of the hollow microspheres 4A include expanded type hollow microspheres and hollow microspheres obtained by expanding the unexpanded thermally expandable microspheres.

The physical properties of the polishing layer 4 such as the shore D hardness can be kept within the desired numerical range by adjusting the composition of the polishing layer 4, the number and the size of the hollow microspheres 4A and the like.

<Cushion Layer>

(Structure)

The polishing pad 3 has cushion layer 6. The cushion layer 6 preferably makes the polishing layer 4 abut the workpiece 8 more uniformly. Examples of the material for the cushion layer 6 include a resin, an impregnated material obtained by impregnating a base material with a resin, materials having flexibility such as a synthetic resin and a rubber and a sponge material made of the resin. Examples of the resin include resins such as polyurethane, polyethylene, polybutadiene and silicon and the rubber such as natural rubber, nitrile rubber and polyurethane rubber.

The cushion layer 6 may be a foam having a bubble structure and the like. As a foam having the bubble structure, a suede-like material having teardrop-shaped bubbles obtained by a wet film forming method and a sponge-like material in which refine bubbles are formed can be preferably used as well as materials having the voids inside such as non-woven fabric.

<Adhesive Layer>

Adhesive layer 7 is a layer for adhering the cushion layer 6 to the polishing layer 4 and generally consist of the double-sided tape or adhesives. A double-sided tape or adhesives known in the art (for example, the adhesive sheet) can be used.

The polishing layer 4 is attached to the cushion layer 6 by the adhesive layer 7. The adhesive layer 7 can be formed from at least one adhesive selected from a group consist of acryl, epoxy and urethane. For example, the adhesive layer 7 is formed from the acryl adhesive and is set to have a thickness of 0.1 mm.

<tan δ>

The polishing pad 3 of the present invention is characterized by that with regard to tan δ which is a ratio of storage elastic modulus E' to loss elastic modulus E" when dynamic viscoelasticity measurement of the whole polishing pad 3 is performed using the frequency dispersion (25° C.) in the bending mode, the ratio of the maximum value of tan δ measured at 100 to 1000 rad/s (tan $\delta_{max100\text{-}1000}$) to the maximum value of tan δ measured at 1 to 10 rad/s (tan $\delta_{max1\text{-}10}$) is 0.75 to 1.30.

The ratio of the maximum value to the minimum value of tan δ measured at 0.1 to 10000 rad/s (the maximum value (tan $\delta_{max0.1\text{-}10000}$)/the minimum value (tan $\delta_{min0.1\text{-}10000}$)) is preferably 1 to 1.3.

The difference between the maximum value and the minimum value of tan δ measured at 0.1 to 10000 rad/s (the maximum value (tan $\delta_{max0.1\text{-}10000}$)−the minimum value (tan $\delta_{min0.1\text{-}10000}$)) is preferably 0 to 1.0.

Tan δ is a ratio (E"/E') of E" (the loss elastic modulus) to E' (the storage elastic modulus). The inventors focused on Tan δ because tan δ might influence the dishing phenomenon depending on the value thereof and studied the relevance between edge sagging and tan δ. The inventors found that when tan δ values obtained by testing the whole polishing pad 3 in the bending mode were kept within the range described above, edge sagging could be prevented.

Namely, when the ratio of the maximum value of tan δ measured at the frequency of 100 to 1000 rad/s to the maximum value of tan δ measured at the frequency of 1 to 10 rad/s is 0.75 to 1.30, tan δ is almost the same even over a wide range of the frequency.

Figure 5:
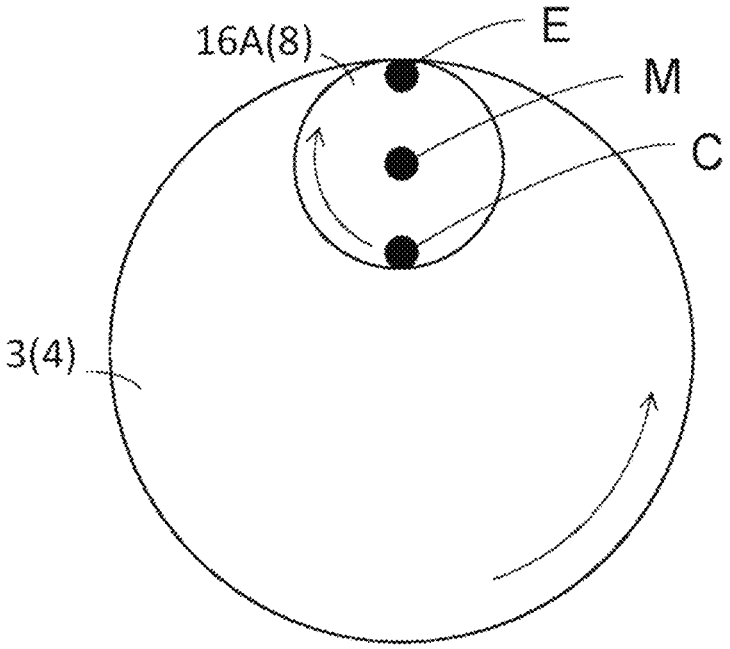
FIG. 5 illustrates that the workpiece 8 arranged in the retainer ring 16A is polished on the polishing pad. The arrows in the figure indicate the rotation directions of the workpiece 8 and the polishing pad 3.

The investigation of the frequency is described with reference to FIG. 5. FIG. 5 is a diagram viewing the polishing state above. The arrows indicate the rotation directions. The workpiece 8 is arranged in retainer ring 16A (or in the holding surface plate 16) and on the polishing layer 4 of the polishing pad 3. The polishing layer 4 is rotated anticlockwise as indicated by the arrow in this example. The workpiece 8 arranged in the retainer ring 16A is rotated clockwise and polishing is carried out.

The frequency of polishing is conventionally considered to be as follows. The general frequency in the polishing is an angular frequency calculated from the contact time and the like calculated from the diameter and the speed of each of the polishing article and the workpiece and is an angular frequency of about 1 to 10 rad/s. Namely the frequency is calculated based on a model that the polishing pad 3 is deformed at a constant speed from when the polishing pad 3 starts coming in contact with the workpiece 8 until when the polishing pad 3 passes through the workpiece 8 and the deformed polishing pad 3 is released to return to the original shape at a constant speed after the polishing pad 3 passes through the workpiece 8.

However, when investigating the frequency to achieve the present invention, the workpiece 8 is actually held by the retainer ring 16A. Accordingly, a certain part of the polishing layer 4 is rotated to first come in contact with the retainer ring 16A, then with the workpiece 8 and next with the retainer ring 16A and to be released finally. When the frequency is calculated taking such circumstance into consideration, the frequency is considered to be about 100 to 1000 rad/s.

Taking the above description into consideration, tan δ is found to be preferably almost the same not only at 1 to 10 rad/s but also at the frequency within the wide range of 100 to 1000 rad/s. In other words, the variation of the ratio of the maximum value of tan δ measured at 100 to 1000 rad/s to the maximum value of tan δ measured at 1 to 10 rad/s is preferably small. Actually when the ratio of the maximum value of tan δ measured at 100 to 1000 rad/s to the maximum value of tan δ measured at 1 to 10 rad/s is 0.75 to 1.30, edge sagging was found to be small.

When the frequency is calculated to be 100 to 1000 rad/s, because the rotation direction of the polishing pad 3 is substantially opposite to the rotation direction of the workpiece 8 around the reference sign E (around the edge of the polishing pad 3) in FIG. 5, the relative speed is the difference between each speed. While because the rotation direction of the polishing pad 3 is substantially the same as the rotation direction of the workpiece 8 around the reference sign C (around the center of the polishing pad 3) in FIG. 5, the relative speed is the sum of each speed. Because the angular speed of the workpiece 8 is 0 around the reference sign M (around the middle part of the polishing pad 3), the relative speed is the same as the rotation speed of the polishing pad 3. It goes without saying that these relative speeds are used when the frequency is calculated to be 100 to 1000 rad/s.

(Dynamic Viscoelasticity Measurement)

Figure 6:
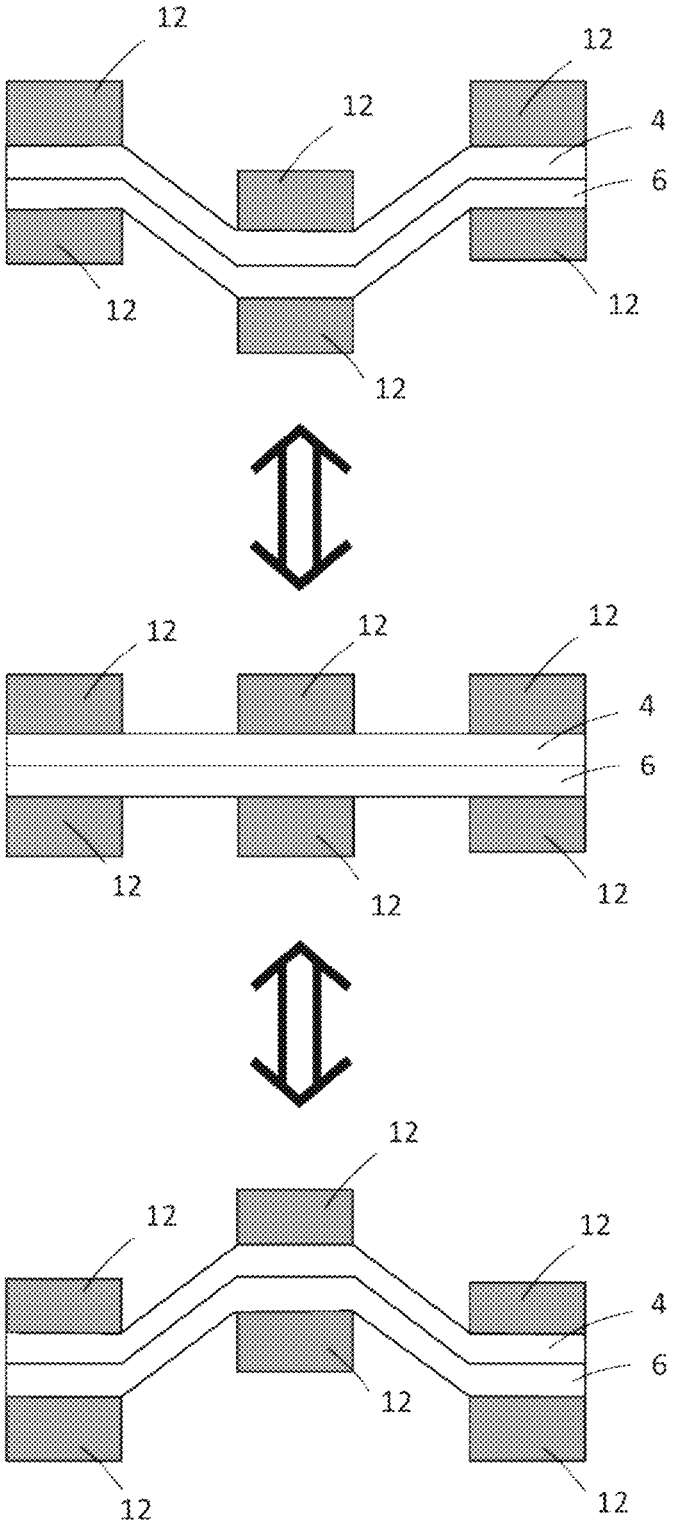
FIG. 6 is the schematic diagram illustrating the dynamic viscoelasticity measurement method of the whole polishing pad 3.

Tan δ is obtained by conducting the dynamic viscoelasticity measurement (DMA: Dynamic Viscoelasticity Analysis) of the whole polishing pad in the bending mode. The dynamic viscoelasticity measurement is a method for measuring the mechanical property of the sample by measuring the stress and the strain generated by applying the strain or the stress that is changed (vibrated) with time to the sample. The schematic diagram illustrating that the dynamic viscoelasticity measurement of the whole polishing pad 3 of the present invention is conducted is shown in FIG. 6. As shown in FIG. 6, the polishing pad 3 is sandwiched by jigs 12 that are contacted with the polishing surface of the polishing layer 4 and with the surface of the cushion layer 6 and the stress is measured when the strain generated by a minute amplitude having a sine wave shape is given. Namely in the present invention, the dynamic viscoelasticity measurement of the whole polishing pad 3 is conducted and the "whole" means that the dynamic viscoelasticity measurement of the only polishing layer 4 of the polishing pad 3 are not conducted as well as the dynamic viscoelasticity measurement of the only cushion layer 6 of the polishing pad 3 are not conducted and that the dynamic viscoelasticity measurement of the polishing pad 3 are conducted under the states that the polishing layer 4 is adhered to the cushion layer 6 with the adhesive layer 7. Note that the adhesive layer 7 is not illustrated in FIG. 6.

The measurement of tan δ of the whole polishing pad 3 is described below.

Figure 8:
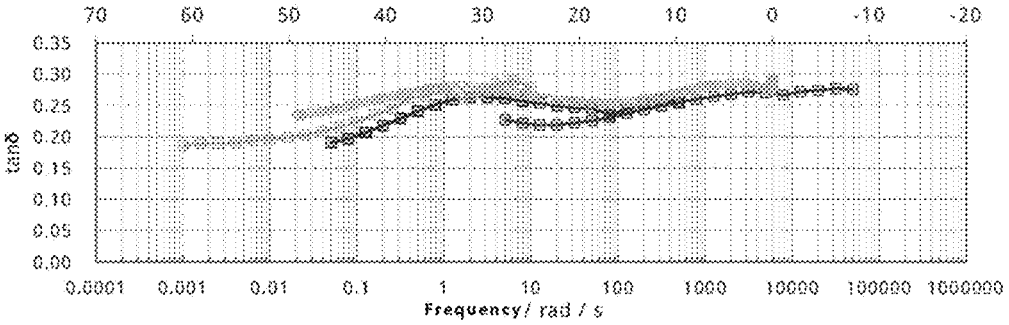
FIG. 8 is the graph of tan δ when the dynamic viscoelasticity measurement of the whole polishing pad of Example 1 was performed in the bending mode.
Figure 10:
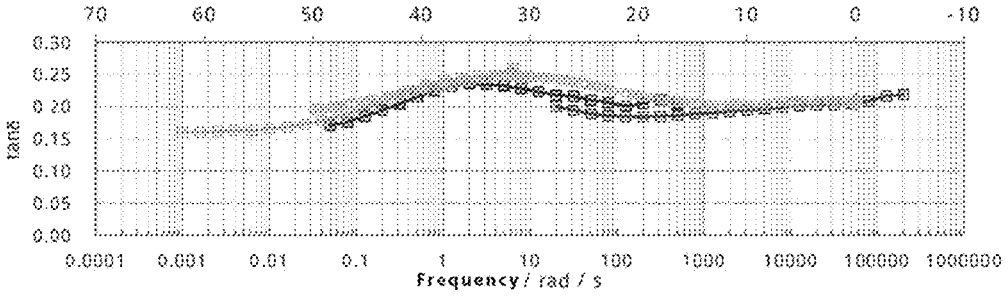
FIG. 10 is the graph of tan δ when the dynamic viscoelasticity measurement of the whole polishing pad of Example 2 was performed in the bending mode.
Figure 12:
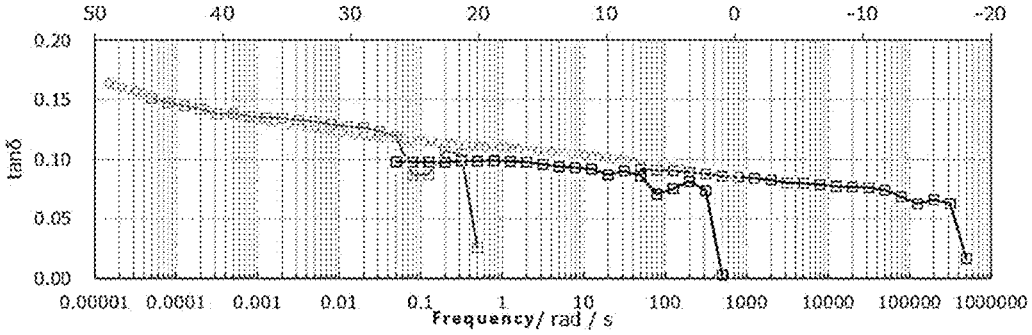
FIG. 12 is the graph of tan δ when the dynamic viscoelasticity measurement of the only polishing layer B of Examples 1 and 2 was performed in the bending mode.

Tan δ is a ratio (E"/E') of E" (the loss elastic modulus) to E' (the storage elastic modulus) and tan δ is influenced not only by the polishing layer 4 but also by the cushion layer 6. Conventionally, the measurement of tan δ is performed only for the material for the polishing layer in the art. However, it is found that not only the material for the polishing layer 4 but also the material for the cushion layer 6 greatly influence tan δ and the size of edge sagging is changed depending on the cushion layer 6. The measurement results of tan δ of the whole polishing pads of the Examples 1 and 2 described below are shown in FIG. 8 and FIG. 10 and the measurement results of tan δ of only the polishing layer B used for the Examples 1 and 2 is shown in FIG. 12. As shown in FIGS. 8, 10 and 12, in some cases the behavior of tan δ measured using the frequency dispersion when measuring only the polishing layer 4 greatly differs from that when measuring the whole polishing pad 3 obtained by integrating the polishing layer 4 with the cushion layer 6. Thus m in the present invention tan δ of the whole polishing pad 3 including not only the polishing layer 4 but also the cushion layer 6 is measured.

Generally, the dynamic viscoelasticity measurement is conducted in the bending mode or in the tensile/compression mode. In the present invention, the dynamic viscoelasticity measurement is conducted in the bending mode. In actual polishing, each layer of the polishing pad 3 is pressed with the workpiece 8 in a vertical direction. Thus, the measurement should be conducted in the measurement mode (the bending mode) that the polishing pad 3 is pressed in the same direction as in actual polishing.

The ratio of the maximum value of tan δ measured at the frequency of 100 to 1000 rad/s to the maximum value of tan δ measured at 1 to 10 rad/s is 0.75 to 1.30, which means that the storage elastic modulus E' and the loss elastic modulus E" within the range of 1 to 10 rad/s are not greatly different from those within the range of 100 to 1000 rad/s. Such polishing pad 3 can prevent edge sagging.

Additionally the ratio (the maximum value/the minimum value) of the maximum value of tan δ to the minimum value of tan δ measured at the frequency of 0.1 to 10000 rad/s is 1 to 1.3, which means that tan δ of the polishing pad 3 dose not vary greatly over a wide frequency range. The difference (the maximum value−the minimum value) between the maximum value of tan δ and the minimum value of tan δ measured at the frequency of 0.1 to 10000 rad/s is 0 to 0.1, which means that tan δ of the polishing pad 3 dose not vary greatly over a wide frequency range.

Note that the value of tan δ can be adjusted by for example, changing the material for the polishing layer 4 and the cushion layer 6 and by changing the size, the number and the density of the bubbles contained in the polishing layer 4 and the cushion layer 6.

<Ratio of Storage Elastic Modulus $E'_{1000}$ to $E'_{10}$>

With regard to the storage elastic modulus E' obtained by performing the dynamic viscoelasticity measurement of the polishing pad 3 using the frequency dispersion (25° C.) in a bending mode, when the ratio ($E'_{1000}/E'_{10}$) of the value of E' measured at 1000 rad/s ($E'_{1000}$) to the value of E' measured at 10 rad/s ($E'_{10}$) is 1 to 2, thereby the step elimination performance of the polishing pad 3 of the present invention is improved. The value of E' of the polishing layer 4 and the cushion layer 6 generally used for the polishing pad 3 is monotonically increased when the frequency is increased. Thus, the material that provides less than 1 of $E'_{1000}/E'_{10}$ is a special material. The physical properties and the polishing performance of such material are often not suitable for the polishing pad, which is not preferable. While when $E'_{1000}/E'_{10}$ is more than 2, the step elimination performance is decreased. The range of $E'_{1000}/E'_{10}$ is preferably not less than 1.4 and not more than 1.9, more preferably not less than 1.5 and not more than 1.85. The storage elastic modulus is the energy component stored inside the object of the energy generated in the object by the eternal force and the strain.

In the measurement of the storage elastic modulus E', the ratio of the value of E' measured at 1000 rad/s to the value of E' measured at 10 rad/s is used to compare the values of the storage elastic modulus measured over a wide frequency range. The reasons why such a wide frequency range is selected are the same as tan δ. The polishing pad 3 of the present invention actually having small variation in the values of the storage elastic modulus E' measured over such a wide frequency range (the ratio of $E'_{1000}$ to $E'_{10}$ is 1 to 2) is excellent in step elimination performance for the workpiece having steps as well as in flattening performance, because the value of E' does not change largely depending on the position of the workpiece.

The storage elastic modulus E' is measured by conducting the dynamic viscoelasticity measurement (DMA) of the whole polishing pad 3 in the bending mode. The measurement method is the same as the method described before and thus is omitted.

The value of the storage elastic modulus E' is influenced by not only the polishing layer 4 but also the cushion layer 6 like tan δ. Conventionally the measurement of the storage elastic modulus E' is conducted only for the material for the polishing layer in the art. However, it is found that not only the material for the polishing layer 4 but also the material for the cushion layer 6 greatly influence the value of the storage elastic modulus E', and the step elimination performance is largely changed depending on the cushion layer 6. In view of the measurement results of the storage elastic modulus E' of the whole polishing pads of the Examples 5 and 6 described below and the measurement results of the storage elastic modulus E' of the whole polishing pad of Comparative Example 1 where the polishing pad has the same polishing layer as Examples 5 and 6 but has the different cushion layer from Examples 5 and 6, in some cases, the behavior of the storage elastic modulus E' measured using the frequency dispersion is changed largely depending on the combination of the polishing layer and the cushion layer. Thus, in the present invention, the storage elastic modulus E' of the whole polishing pad including not only the polishing layer but also the cushion layer is measured.

Note that the value of the storage elastic modulus E' can be adjusted by for example, not only changing the material for the polishing layer 4 and the cushion layer 6 and by adjusting the hardness, the density, the compression rate of the polishing layer 4 and the cushion layer 6, but also by changing the size, the number and the density of the bubbles contained in the polishing layer 4 and the cushion layer 6. It is important that the ratio of $E'_{1000}$ to $E'_{10}$ is 1 to 2. The ratio of $E'_{1000}$ to $E'_{10}$ is 1 to 2, which means that the storage elastic modulus E' dose not vary greatly over a wide frequency range.

Figure 7:
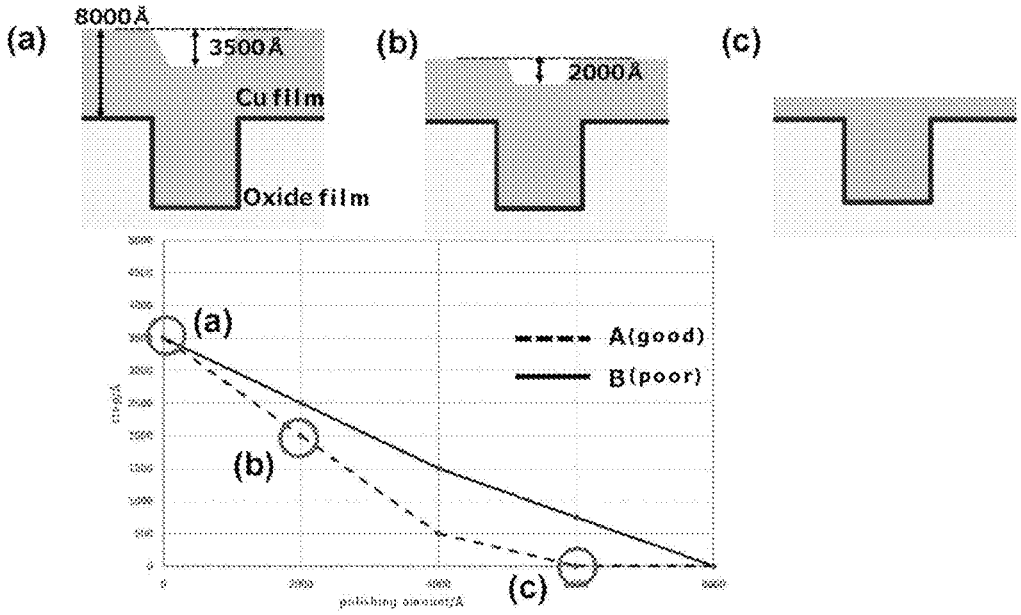
FIG. 7 is the schematic diagram illustrating the state of the steps in the step polishing amount test.

The step elimination performance is performance regarding reduction of the steps (the unevenness) of the pattern wafer with polishing. The schematic diagram illustrating the experiment for the evaluating the step elimination performance is shown in FIG. 7. When there is a step of 3500 angstroms on the workpiece, a state that the step is eliminated by the polishing pad having high step elimination performance (the dotted line) and another state that the step is eliminated by the polishing pad having relatively low step elimination performance (the solid line) are shown. At the time of (a) in FIG. 7, there is no difference in the step between the workpieces. It is shown that when polishing progresses and the polishing amount is 2000 angstroms, the step of the workpiece polished by the polishing pad having excellent step elimination performance (the dotted line) is smaller than the step of the workpiece polished by the polishing pad having relative low step elimination performance (the solid line) (b) and that the step of the workpiece polished by the polishing pad having high step elimination performance is eliminated, even though the polishing amount polished by the polishing pad having high step elimination performance is relatively small (c). The polishing pad indicated by the dotted line has relatively higher step elimination performance than the polishing pad indicated by the solid line.

<<Manufacturing Method of Polishing Pad>>

The manufacturing method of the polishing pad 3 of the present invention is described below.

<Material for Polishing Layer>

The material for the polishing layer 4 is not particular limited. As a main component of the material for example, polyurethane resin, polyurea resin and polyurethanepolyurea resin are preferable and polyurethane resin is more preferable. Examples of the specific material for the main component include the material obtained by the reacting the polyisocyanate compound having urethane bond with a curing agent.

Hereinafter the manufacturing method of the material for the polishing layer 4 is described with reference to the example in which an isocyanate compound having urethane bond, a polyol compound and a curing agent are used.

The manufacturing method of the polishing layer 4 using polyisocyanate compound having urethane bond and the curing agent includes a method including a material preparing step for preparing at least polyisocyanate compound having urethane bond, an additives and a curing agent, a mixing step for mixing the polyisocyanate compound having urethane bond, the additives and the curing agent to obtaining the mixture to be molded into the molded article and a curing step for molding the mixture to be mold into the polishing layer 4.

Hereinafter the manufacturing method is divided into the material preparing step, the mixing step and the molding step, which are described below.

<Material Preparing Step>

Polyisocyanate compound having urethane bond, the curing agent are prepared as a material for the polyurethane resin molded article (the cured resin) to manufacture the polishing layer 4 of the present invention. Polyisocyanate compound having urethane bond is a urethane prepolymer to form the polyurethane resin molded article. When the polyurea resin molded article and the polyurethanepolyurea resin molded article are used for making the polishing layer 4, prepolymers corresponding to the materials for the polishing layer 4 are used.

Each component is described below.

(Polyisocyanate Compound Having Urethane Bond)

Polyisocyanate compound having a urethane bond (urethane prepolymer) is a compound obtained by reacting a polyisocyanate compound described below with a polyol compound under the conditions used generally and has a urethane bond and an isocyanate group in a molecule. Other components may be included in the polyisocyanate compound having a urethane bond within a range not impairing the effect of the present invention.

As a polyisocyanate compound having a urethane bond, the commercial products may be used and the compounds synthesized by reacting a polyisocyanate compound with a polyol compound may be used. The reaction aforementioned is not particularly limited. The addition polymerization may be performed using methods and conditions known in the technique for manufacturing the polyurethane resin. For example, a polyisocyanate compound having a urethane bond can be manufactured by the method where the polyisocyanate compound heated to 50° C. is added to the polyol compound heated to 40° C. under nitrogen atmosphere while stirring and the mixture is heated to 80° C. in 30 minutes and reacted further for 60 minutes at 80° C.

Note that the NCO equivalent of the polyisocyanate compound having a urethane bond is preferably about 300 to 600. Accordingly, when the commercial products are used, the NCO equivalent of the commercial products is preferably within the range described above. When polyisocyanate compound having a urethane bond is manufactured by synthesizing, the NCO equivalent is preferably within the range described above by using the materials described below in appropriate proportion.

(Poyisocyanate Compound)

In this specification, a polyisocyanate compound means a compound having not less than two isocyanate groups in a molecule.

Polyisocyanate compound is particularly limited as long as the compound has not less than two isocyanate groups in a molecule. Examples of the diisocyanate compound having two isocyanate groups in a molecule can include m-phenylene diisocyanate, p-phenylene diisocyanate, 2,6-tolylene diisocyanate (2,6-TDI), 2,4-tolylene diisocyanate (2,4-TDI), naphthalene-1,4-diisocyanate, diphenylmethane-4,4'-diisocyanate (MDI), 4,4'-methylene-bis(cyclohexylisocyanate) (hydrogenated MDI), 3,3'-dimethoxy-4,4'-biphenyl diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate, p-phenylene diisothiocyanate, xylylene-1,4-diisothiocyanate, and ethylidyne diisothiocyanate. These polyisocyanate compound may be used alone or in combination of two or more.

Examples of polyisocyanate compound preferably includes 2,4-TDI and/or 2,6-TDI.

(Polyol Compound as Material for Prepolymer)

In this specification, a polyol compound means a compound having not less than two hydroxy groups (OH) in a molecule.

Examples of the polyol compound used for the synthesis of the polyisocyanate compound having a urethane bond as a prepolymer can include diol compounds such as ethylene glycol, diethylene glycol (DEG) and butylene glycol, triol compounds; polyether polyol compounds such as poly (oxytetramethylene)glycol (or polytetramethyleneetherglycol) (PTMG). DEG and PTMG are preferable among them.

The number average molecular weight (Mn) of PTMG is not particularly limited and for example, may be 500 to 2,000. The number average molecular weight can be measured by Gel Permeation Chromatography (GPC). Note that when the number average molecular weight of polyol from polyurethane resin is measured, the polyurethane resin is degraded into each component by the conventional methods such as amine degradation and then the number average molecular weight of polyol can be measured by GPC.

These polyol compounds may be used alone or in combination of two or more.

(Additives)

As described above the additives such as oxidant may be added as a material for the polishing layer 4 as necessary.

(Curing Agent)

In the manufacturing method of the polishing layer 4 of the present invention, a curing agent (also referred to as the chain expender) is mixed with the polyisocyanate compound having a urethane bond and the like in the mixing step. By adding the curing agent in the subsequent molding step, the end of the main chain of the polyisocyanate compound having a urethane bond is combined with the curing agent to form the polymer chain and to be cured.

Examples of the curing agent include polyamine compounds such as ethylenediamine, propylenediamine, hexamethylenediamine, isophoronediamine, dicyclohexylmethane-4,4'-diamine, 3,3'-dichloro-4,4'-diaminodiphenylmethane (MOCA), 4-methyl-2,6-bis(methylthio)-1,3-benzenediamine, 2-methyl-4,6-bis(methylthio)-1,3-benzenediamine, 2,2-bis(3-amino-4-hydroxyphenyl) propane, 2,2-bis[3-(isopropylamino)-4-hydroxyphenyl]propane, 2,2-bis[3-(1-methylpropylamino)-4-hydroxyphenyl]propane, 2,2-bis[3-(1-methylpentylamino)-4-hydroxyphenyl]propane, 2,2-bis(3,5-diamino-4-hydroxyphenyl) propane, 2,6-diamino-4-methylphenol, trimethylethylenebis-4-aminobenzoate and polytetramethylene oxide-di-p-aminobenzoate; and polyhydric alcohol compounds such as ethylene glycol, propylene glycol, diethylene glycol, trimethylene glycol, tetraethylene glycol, triethylene glycol, dipropylene glycol, 1,4-butanediol, 1,3-butanediol, 2,3-butanediol, 1,2-butanediol, 3-methyl-1,2-butanediol, 1,2-pentanediol, 1,4-pentanediol, 2,4-pentanediol, 2,3-dimethyltrimethylene glycol, tetramethylene glycol, 3-methyl-4,3-pentanediol, 3-methyl-4,5-pentanediol, 2,2,4-trimethyl-1,3-pentanediol, 1,6-hexanediol, 1,5-hexanediol, 1,4-hexanediol, 2,5-hexanediol, 1,4-cyclohexanedimethanol, neopentyl glycol, glycerin, trimethylolpropane, trimethylolethane, trimethylolmethane, poly(oxytetramethylene)glycol, polyethylene glycol and polypropylene glycol. The polyamine compound may have hydroxyl group, and examples of such an amine-based compound can include 2-hydroxyethyl ethylenediamine, 2-hydroxyethyl propylenediamine, di-2-hydroxyethyl ethylenediamine, di-2-hydroxyethyl propylenediamine, 2-hydroxypropylethylenediamine and di-2-hydroxypropylethylenediamine. The polyvalent amine compound is preferably a diamine compound. For example, 3,3'-dichloro-4,4'-diaminodiphenylmethane (methylenebis-o-chloroaniline) (hereinafter abbreviated as MOCA) is more preferably used.

The polishing layer 4 is molded by using the hollow microsphere 4A having an outer shell and a hollow part inside as a material. As a material for the hollow microsphere 4A, the commercial products may be used and the hollow microsphere obtained by synthesizing by the conventional method may be used. The material for the outer shell of the hollow microsphere 4A is not particularly limited. Examples thereof include polyvinylalcohol, polyvinylpyrrolidone, poly(meth)acrylic acid, polyacrylamide, polyethyleneglycol, polyhydroxyetheracrylite, maleic acid copolymer, polyethyleneoxide, polyurethane, poly(meth) acrylonitrile, polyvinylidenechloride, polyvinylchloride, organic silicon resin and copolymer obtained by combining two or more kinds of the monomers of these resins (for example, the acrylonitrile-vinylidenechloride copolymer). Examples of the hollow microsphere available commercially, which are not limited to the following, include Expancel series (trade name, manufactured by Akzo Nobel N. V.) and Matsumoto Microsphere (trade name, manufactured by Matsumoto Yushi-Seiyaku Co., Ltd.).

The gas contained in the hollow microsphere 4A is not particularly limited and include hydrocarbon and specifically isobutane.

The shape of the hollow microsphere 4A is not particularly limited, and may be, for example, a spherical shape or a substantially spherical shape. The average particle size of the hollow microsphere 4A is not particularly limited, and is preferably 5 to 200 μm, more preferably 5 to 80 μm, further preferably 5 to 50 μm, particularly preferably 5 to 35 μm. The average particle size can be measured with, for example, laser diffraction particle size distribution measurement apparatus (for example, Mastersizer-2000 manufactured by Spectris Co., Ltd.).

The hollow microsphere 4A is preferably added in an amount of 0.1 to 10 parts by mass, more preferably 1 to 5 parts by mass, still more preferably 1 to 4 parts by mass based on 100 parts by mass of the urethane prepolymer.

The foaming agent conventionally used may be used together with the hollow microsphere 4A, or any gas non-reactive with the above each component may be blown in the following mixing step, in addition to the above components, as long as the effects of the present invention are not impaired. Examples of the foaming agent include water and the foaming agent mainly containing a hydrocarbon having 5 or 6 carbon atoms. Examples of the hydrocarbon include chain hydrocarbons such as n-pentane and n-hexane, and alicyclic hydrocarbons such as cyclopentane and cyclohexane.

<Mixing Step>

In the mixing step, the polyisocyanate compound having a urethane bond (urethane prepolymer), the additives, the curing agent obtained in the preparing step described above are supplied into the mixing machine and stirred/mixed. The mixing step is performed at a temperature at which the fluidity of each component described above is secured.

<Molding Step>

In the molding step, the mixture to be molded into the molded article prepared in the mixing step aforementioned is poured into the square-shaped molding box heated at 30 to 100° C. in advance and cured primarily. Then the mixture cured primarily is heated at about 100 to 150° C. for 10 minutes to 5 hours to cure secondly. The cured polyurethane resin (polyurethane resin molded article) is molded by the secondly curing. At that time, the urethane prepolymer reacts with the curing agent to form the urethane resin and thereby the mixture is cured.

When the viscosity of urethane prepolymer is too high, the fluidity is lowered and the urethan prepolymer is difficult to be mixed almost uniformly during mixing. When the temperature is raised and the viscosity is lowered, the pot life is shortened. As a result, "mix spots" are generated and the variation in the size of the hollow microsphere 4A formed in the foam occur. On the contrary when the viscosity is too low, the bubbles move in the mixture and a foam in which the hollow microspheres 4A are dispersed almost uniformly is difficult to obtain. Thus, the viscosity of the prepolymer at 50 to 80° C. is preferably set within a range of 500 to 4000 mPa·s. For example, the viscosity can be set by changing the molecular weight of the prepolymer (the degree of the polymerization). The prepolymer is heated to about 50 to 80° C. to be flowable.

In the molding step, the mixture poured into the molding box is reacted to form a foam in the molding box as necessary. At that time, the prepolymer is crosslinked and cured by the reaction of the prepolymer and the curing agent.

After the molded article is obtained, the molded article is sliced into sheet-like pieces to form more than one polishing layers. The general slicer can be used for slicing. At slicing, the lower part of the molded article is held and the molded article is sliced into pieces having a prescribed thickness from the upper part of the molded article in order. The slice thickness is for example, set to be within a range of 1.3 to 2.5 mm. When the foam is molded in the molding box having a thickness of 50 mm, for example, the upper part having a thickness of 10 mm and the lower part having a thickness of 10 mm are not used because of flaws and the like and the central part having a thickness of 30 mm is sliced into 10 to 25 polishing layers 4. In the molding step, the foam in which the hollow microspheres 4A are formed almost uniformly is obtained.

The grooving is performed on the polishing surface of the polishing layer 4 as necessary. By performing the cutting and the like on the polishing surface with the required cutter, a groove having a predetermined pitch, a predetermined width and a predetermined depth can be formed. Examples of the slurry holding groove includes the circular groove formed concentrically and the slurry discharging groove includes the straight-line groove formed into a lattice-like state and the straight-line groove formed radically from the center of the polishing layer 4.

Then the double-sided tape is attached on the surface opposite to the polishing surface of the polishing layer 4 obtained in the above manners. The double-sided tape is particularly not limited and the double-sided tape arbitrarily selected from the double-sided tapes known in the art can be used.

<<Manufacturing Method of Cushion Layer 6>>

As described above, examples of the material for the cushion layer 6 includes the impregnated material obtained by impregnating the base materials such as the non-woven fabric and the woven fabric made of the polyethylene fiber, the polyester fiber and the like with the resin solution such as urethane; the suede material made of the resin material such as urethane; and the sponge material made of the material such as urethane. Among them, the manufacturing methods of the woven fabric or the non-woven fabric impregnated with polyurethane resin; and the suede material made of the resin material such as urethane are described. Note that the cushion layer 6 can be manufactured according to the manufacturing method described below but the commercial products can be used for the cushion layer 6.

<Manufacturing Method of Cushion Layer Using Impregnated Material and Suede Material>

In the forming step of the cushion layer 6, the cushion layer 6 is formed by wet film forming. Namely the cushion layer 6 is formed through each step of the preparing step in which the resin solution obtained by dissolving polyurethane resin in the organic solvent almost uniformly is prepared, the coagulating/regenerating step in which the resin solution prepared in the preparing step is spread into a sheet-like state and coagulated/regenerated into the urethane body by removing the organic solvent from the resin solution in the aqueous coagulating solution and the washing/drying step in which the urethane body coagulated/regenerated in the coagulating/regenerating step is washed and dried to form the cushion layer 6. Hereinafter the steps are described in order.

(Preparing Step)

In the preparing step, the resin solution is prepared by dissolving polyurethane resin and additives, if necessary, in the organic solvent. The polyurethane resin and the additives are dissolved in the water-miscible organic solvent capable of dissolving the urethane resin almost uniformly and the aggregate and the like are removed by the filtration. Then the resin solution is prepared by deforming under vacuum. As the organic solvent N, N-dimethylformamide (hereinafter abbreviated as DMF), dimethylacetamide (hereinafter abbreviated as DMAc) and the like can be used. For example, DMF is used as the organic solvent. Polyurethane resin can be selected from the resins such as polyester based polyurethane resin, polyether-based polyurethane resin and polycarbonate-based polyurethane to use.

As additives added if necessary, the pigments such as the carbon black, the hydrophilic activator accelerating the foaming, the hydrophobic activator stabilizing the coagulation/regeneration of urethane resin and the like can be used. By changing the kind and the amount of the additives, the size and the amount (the number) of the tear-shaped bubbles formed inside the cushion layer 6 can be controlled. The physical properties of the cushion layer 6 also influences the adjustment of tan δ and the storage elastic modulus E' of the polishing pad 3. Hence, tan δ and the storage elastic modulus E' of the polishing pad 3 are adjusted by the selection of the material, the selection of the organic solvent, the mixing ratio of the resin and the organic solvent, the size and the mount of the tear-shaped bubbles and the setting of the thickness of the cushion layer 6 according to circumstances. For example, the polyurethane resin is set to be 45 to 62 parts by mass and DMF is set to be 8 to 32 parts by mass based on 100 parts by mass of the resin solution, respectively.

(Coagulating/Regenerating Step)

In the coagulating/regenerating step, the polyurethane resin is coagulated/regenerated into a sheet-like state by applying the resin solution prepared in the preparing step on a base for forming a film continuously (spreading into a sheet-like state) and dipping the base applied with the resin solution in the aqueous coagulating solution. The resin solution prepared in the preparing step is applied by the coating machines such as the knife coater on the belt-like film forming base at a room temperature almost uniformly. At that time, by adjusting the clearance between the coating machine and the base, the thickness of the application (the applying amount) of the resin solution is adjusted. In the present invention, the applying amount is adjusted so that the thickness of the cushion layer 6 is within a range of 0.5 to 2.0 mm. The flexible film, the non-woven fabric, the woven fabric and the like can be used as a base for forming a film. When the non-woven fabric and the woven fabric are used, the pretreatment of dipping the fabric in water or the DMF solution (the mixture of DMF and water) (the filling) is performed in advance to prevent the resin solution from permeating into the base at the application of the resin solution.

The base applied with the resin solution is dipped into the aqueous coagulating solution containing water which is poor solvent to the polyurethane resin as a main component. First in the aqueous coagulating solution, the fine porous skin layer having a thickness of about a few μm is formed on the surface of the resin solution applied. Then the polyurethane body is coagulated/regenerated on the one side of the base into a sheet-like state by the progress of the replacement of the DMF in the resin solution with the aqueous coagulating solution. A number of tear-shaped bubbles are formed in the polyurethane body into a stereoscopic mesh-like state by removing DMF from the resin solution and the replacement of the DMF with the aqueous coagulating solution. Because water is not permeated through the PET film of the film forming base, the solvent is removed in the surface-side (the skin layer-side) of the resin solution and the tear-shaped bubble having a larger hole size in the film forming base-side than in the surface-side is formed Namely in the polyurethane body, a number of foam having a roundish almost triangle shape, which is a cross section shape, along the thickness direction of the polyurethane body are formed in the state of dispersing almost uniformly.

(Washing/Drying Step)

In the washing/drying step, the belt-like (long) polyurethane body obtained by coagulating/regenerating the resin solution in the coagulating/regenerating step is washed and then dried to form the cushion layer 6. Namely DMF remained in the polyurethane body is removed by washing with the cleaning liquid such as water. After washing, the polyurethane body is dried in the cylinder drier. The cylinder drier is provided with a cylinder having a heat source inside. The polyurethane body is dried by passing through the cylinder along the circumferential surface of the cylinder to form the cushion layer 6.

<<Joining Step>>

In the jointing step, the polishing layer 4 and the cushion layer 6 formed are attached (joined) with the adhesive layer 7. The adhesive layer 7 is for example, formed so as to have a thickness of 0.1 mm by using acryl adhesive. Namely the acryl adhesive is applied on the surface opposite to the polishing surface of the polishing layer 4 in an almost uniform thickness. By crimping the surface opposite to the polishing surface of the polishing layer 4 to the surface of the cushion layer 6 (the surface on which the skin layer is formed) through the adhesive applied, the polishing layer 4 and the cushion layer 6 are attached with the adhesive layer 7. After cutting into the desired shapes such as a circle, the checks such as the work of confirming that there is no stain and the foreign body and the like stuck are performed to complete the polishing pad 3.

EXAMPLES

Hereinafter, the present invention is described in detail with reference to Examples, but not limited to Examples.

In each of Examples and Comparative Examples "parts" means "parts by mass" unless otherwise stated.

NCO equivalent means a value indicating the molecular weight of the prepolymer (PP) per a NCO group obtained according the formula that "(the mass of polyisocyanate compound+the mass of polyol compound (parts))/[(the number of the functional group per one molecule of polyisocyanate compound×the mass of polyisocyanate compound (parts)/the molecular weight of polyisocyanate compound)−(the number of the functional group per one molecule of polyol compound×the mass of polyol compound (parts)/the molecular weight of polyol compound)].

(Polishing Layer A)

2.6 parts of the unexpanded-type hollow microsphere the shell part of which is made from acrylonitrile-vinylidene chloride copolymer and containing isobutane gas inside the shell were added to 100 parts of an isocyanate group-terminated urethane prepolymer of 460 NCO equivalent obtained by reacting of 2,4-tolylenediisocyanate (TDI) with poly(oxytetramethylene)glycol (PTMG) and diethyleneglycol (DEG) and mixed to obtain the mixture. The mixture obtained was charged into the first liquid tank and kept warm. Next, separately from the first liquid, as a curing agent, MOCA 25.5 parts and polypropyleneglycol (PPG) 8.5 parts were mixed and kept warm in the second liquid tank. Each liquid of the first liquid tank and the second liquid tank was poured into a mixer provided with two inlets from each inlet so that the R value that is an equivalent ratio of amino group and hydro group of the curing agent to terminal isocyanate group of prepolymer could be 0.90. While mixing and stirring two liquids poured, the mixture was poured into the preheated mold of the molding machine. Then mold clamping was performed and the mixture was heated for 30 minutes to be primarily cured. After taken off from the mold, the molded article primarily cured was secondarily cured at 130° C. for two hours in an oven to obtain a urethane molded article. After the urethane molded article obtained was allowed to cool to 25° C., the urethane molded article was heated at 120° C. for 5 hours in the oven again. Then the polishing layer A was obtained by slicing into a thickness of 1.3 mm.

(Polishing Layer B)

The polishing layer B was obtained by the same manufacturing method as the polishing layer A except that the first liquid is a mixture of isocyanate-terminated polyurethane of 455 NCO equivalent 100 parts and the unexpanded typed hollow microsphere 2.7 parts and that the second liquid is only MOCA 25.8 parts.

(Polishing Layer C)

The polishing layer C was obtained by the same manufacturing method as the polishing layer A except that the first liquid is the mixture of isocyanate-terminated polyurethane of 460 NCO equivalent 100 parts, 4,4'-methlene-bis(cyclohexylisocyanate) (hydrogenated MDI) 2 parts and the unexpanded typed hollow microsphere 2.85 parts and that the second liquid is only MOCA 28 parts.

(Polishing Layer D)

"IC1000" (trade name, manufactured by Nitta Haas Incorporated) was used as polishing layer D.

(Cushion Layers (I) to (V))

PolyesterMDI (diphenylmethanediisocyanate) polyurethane resin was used as a polyurethane resin for manufacturing the cushion layer (I). 25 parts of DMF that is a solvent, 40 parts of DMF dispersion liquid containing the carbon black of 20% as the pigment and 2 part of the hydrophobic activator that is a film forming stabilizer were added to 100 parts of 30% solution of polyurethane resin 100 and mixed to prepare the resin solution. The resin solution obtained was applied on the PET base (0.188 mm in thickness) in thickness of 0.7 mm and the organic solvent was removed in the aqueous coagulating solution from the resin solution to manufacture the cushion layer (I) containing the PET base.

The commercially available polyurethane sheet having microbubbles ("Sekisui Sponge 2504KMS" manufactured by SEKISUI CHEMICAL CO., LTD.) was used as the cushion layer (II).

The commercially available polyurethane sheet having microbubbles ("PORON HH-48C" manufactured by INOAC CORPORATION) was used as the cushion layer (III).

The non-woven fabric made of polyester fiber (the density: 0.216 g/cm$^3$) was dipped in polyurethane resin solution ("C1367" manufactured by DIC CORPORATION). After dipping, the resin solution was squeezed with a mangle roller capable of pressurizing between a pair of rollers to impregnate the non-woven fabric with the resin solution almost uniformly. Next, by dipping the fabric in the coagulating solution made of water at the room temperature, the resin impregnated was coagulated/regenerated to obtain the non-woven fabric impregnated with the resin. Then the non-woven fabric impregnated with the resin was taken out from the coagulating solution, dipped again in the cleaning liquid made of water to remove N, N-dimethylformamide (DMF) contained in the resin and then dried. After drying, the skin layer of the surface was removed by the buffing treatment to manufacture the cushion layer (IV). Cushion layer (IV) had a resin adhesion rate of 55% and a thickness of 1.00 mm.

A "SUBA400" (trade name, manufactured by Nitta Haas Incorporated) was used as the cushion layer (V).

EXAMPLES AND COMPARATIVE EXAMPLES

The polishing layers A to D were joined to the cushion layers (I) to (V) with the double-sided tape having a thickness of 0.1 mm (the PET base provided with the adhesive layer made of acryl adhesive on both sides) and the doble-sided tape was attached on the surface of the cushion layer 6 opposite to the adhesive layer 7 to manufacture the polishing pad 3 of Examples and Comparative Examples. The polishing layer 4 and the cushion layer 6 of each Example/Comparative Example are shown in Table 1.

TABLE 1

| | Example 1 | Example 2 | Example 3 | Example 4 | Example 5 | Example 6 | Comparative Example 1 | Comparative Example 2 |
|---|---|---|---|---|---|---|---|---|
| Polishing layer | Polishing layer B | | Polishing layer A | | Polishing layer C | | Polishing layer C | Polishing layer D |
| Cushion layer | (II) | (IV) | (I) | (IV) | (II) | (IV) | (III) | (V) |

(Dynamic Viscoelasticity Measurement 1)

The dynamic viscoelasticity measurement of the polishing pads (obtained by adhering the polishing layer to the cushion layer with the double-sided tape) of Examples and Comparative Examples was performed on the basis of the conditions described below. The polishing pad in a dry states obtained by holding the polishing pad for 40 hours in the thermohydrostat bath having a temperature of 23° C. (±2° C.) and a relative humidity of 50% (±5%) was used as the sample and the dynamic viscoelasticity measurement in the bending mode under the general air atmosphere (the dry state) was performed. The measurement conditions in the bending mode were described as follows.

(Measurement Conditions)

Measurement apparatus: RSA-G2 (manufactured by TA instruments)

Sample: 5 cm in length×0.5 cm in width×0.125 cm in thickness

Test mode: bending mode

Frequency: about 0.01 to about 10000 ($10^{-2}$ to $10^{4}$) rad/s

Measurement temperature: 5° C., 25° C., 45° C.

Strain range: 0.10%

Figure 13:
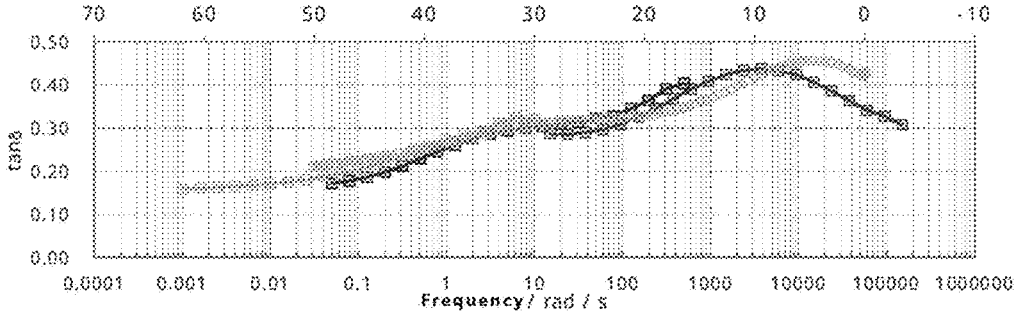
FIG. 13 is the graph of tan δ when the dynamic viscoelasticity measurement of the whole polishing pad of Comparative Example 1 was performed in the bending mode.

As described above the measurement was performed at the temperatures of 5° C., 25° C. and 45° C. using the frequency dispersion. The measurement graph was synthesized by using the temperature-frequency conversion rule and tan δ was calculated at 0.001 to 100000 rad/s. The measurement results of Examples and Comparative Examples are shown in Table 2. The overall results of Example 1, Example 2 and Comparative Example 1 are shown in FIG. 8, FIG. 10 and FIG. 13 respectively. The results of the polishing layer B alone are shown in FIG. 12 as reference.

TABLE 2

| | Example 1 | Example 2 | Example 3 | Example 4 | Example 5 | Example 6 | Comparative Example 1 | Comparative Example 2 |
|---|---|---|---|---|---|---|---|---|
| $\tan\delta_{max1\text{-}10}$ | 0.281 | 0.248 | 0.242 | 0.222 | 0.216 | 1.183 | 0.299 | 0.250 |
| $\tan\delta_{max100\text{-}1000}$ | 0.280 | 0.221 | 0.218 | 0.197 | 0.244 | 1.155 | 0.408 | 0.342 |
| Ratio ($\tan\delta_{max100\text{-}1000}/\tan\delta_{max1\text{-}10}$) | 0.995 | 0.893 | 0.902 | 0.890 | 1.127 | 1.850 | 1.364 | 1.366 |
| $\tan\delta_{max0.1\text{-}10000}$ | 0.294 | 0.248 | 0.253 | 0.222 | 0.254 | 1.183 | 0.452 | 0.342 |
| $\tan\delta_{max0.1\text{-}10000}$ | 0.252 | 0.200 | 0.199 | 0.178 | 0.201 | 1.143 | 0.228 | 0.196 |
| $\tan\delta_{max0.1\text{-}10000}/\tan\delta_{max0.1\text{-}10000}$) | 1.166 | 1.236 | 1.267 | 1.243 | 1.261 | 1.277 | 1.987 | 1.754 |
| $\tan\delta_{max0.1\text{-}10000}-\tan\delta_{max0.1\text{-}10000}$) | 0.042 | 0.047 | 0.053 | 0.043 | 0.053 | 1.040 | 0.225 | 0.146 |

(Resalt of Polishing Test)

Figure 1:
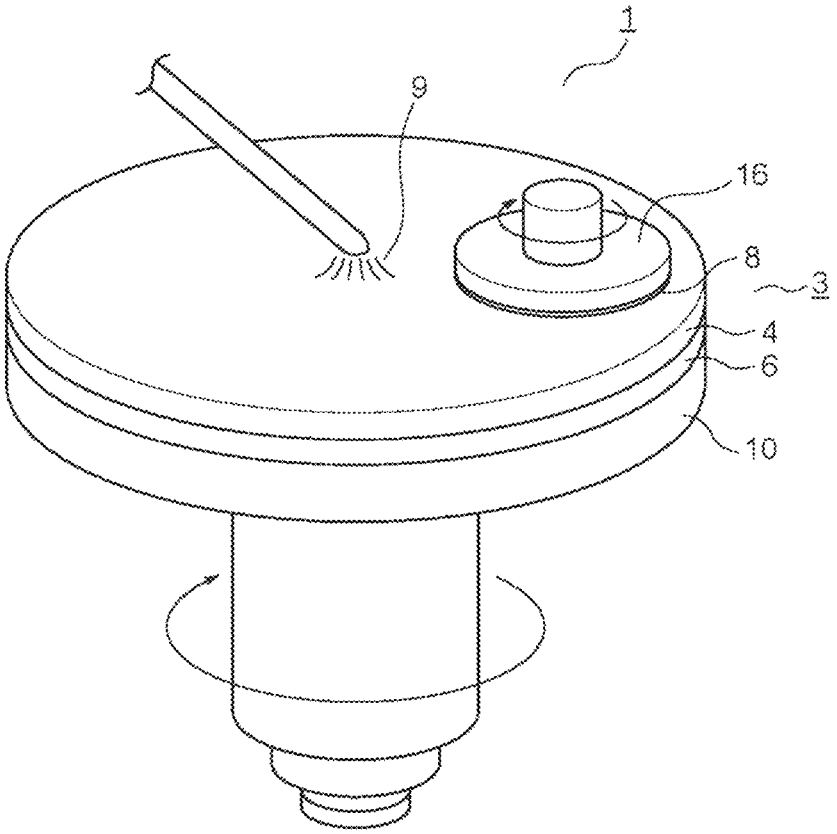
FIG. 1 is the perspective view of the polishing apparatus 1.
Figure 2:
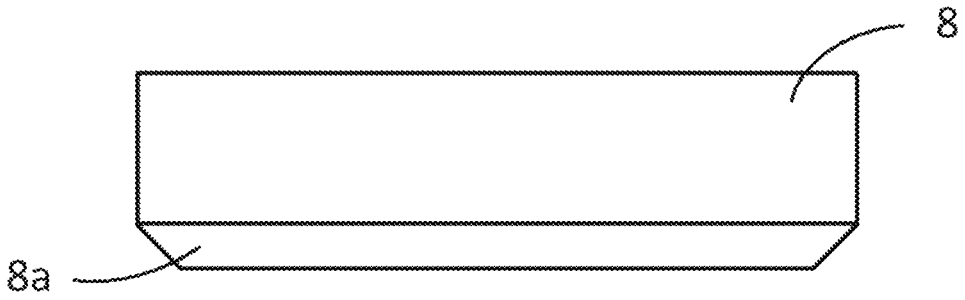
FIG. 2 is the side view of the workpiece 8 with edge sagging.
Figure 3:
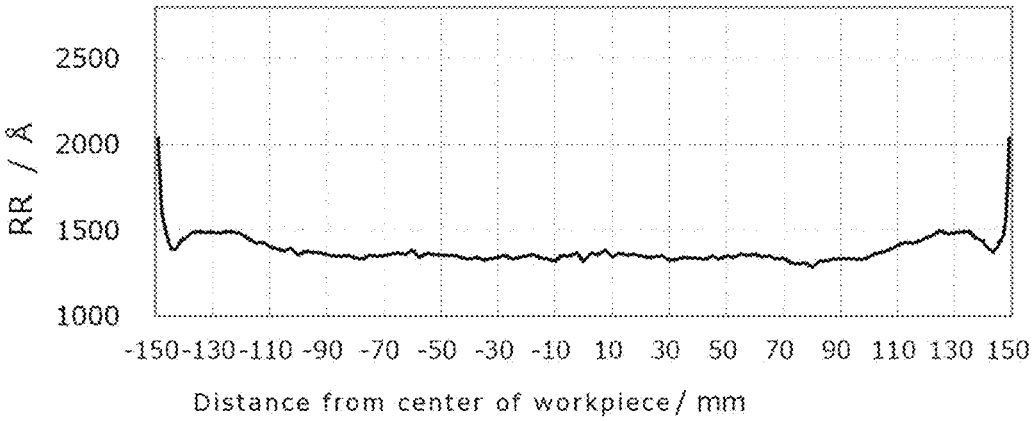
FIG. 3 illustrates the profile of the removal rate of the whole workpiece 8 on the strait line passing through the center of the workpiece 8 polished by the conventional technique (the polishing pad of Comparative Example 1) (the profile of the workpiece polished fiftiethly).
Figure 9:
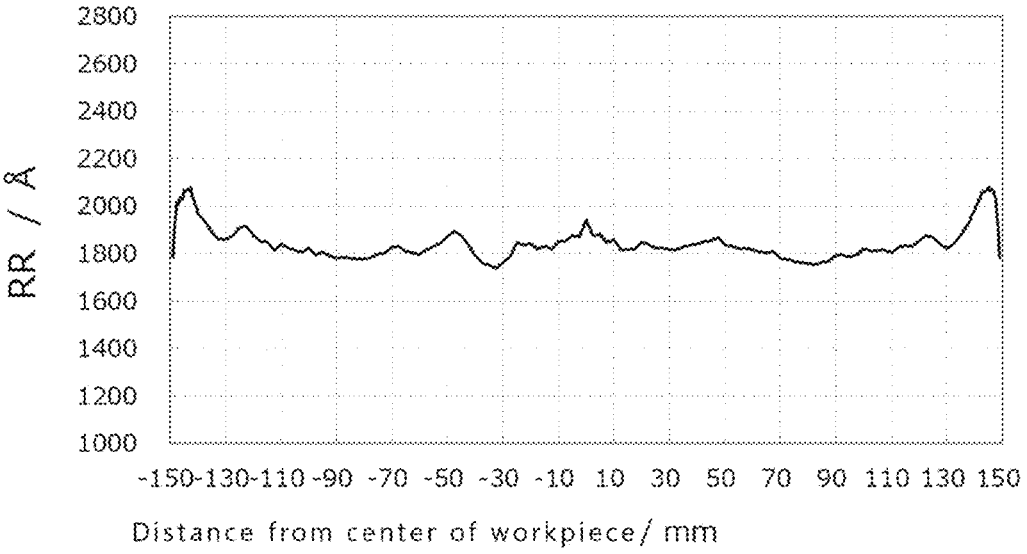
FIG. 9 illustrates the profile of the removal rate of the whole workpiece 8 on the strait line passing through the center of the workpiece 8 polished by the polishing pad in Example 1 (the profile of the workpiece polished fiftiethly).
Figure 11:
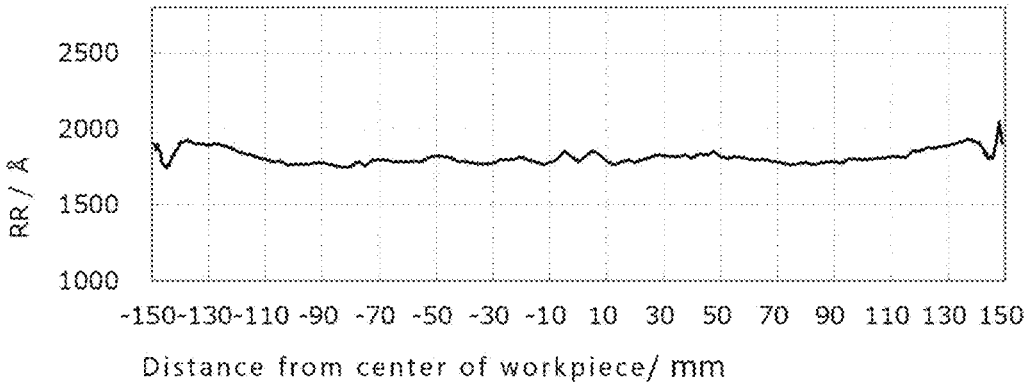
FIG. 11 illustrates the profile of the removal rate of the whole workpiece 8 on the strait line passing through the center of the workpiece 8 polished by the polishing pad in Example 2 (the profile of the workpiece polished fiftiethly).

Polishing was performed using the polishing pads of Examples and Comparative Examples under the polishing condition described below. When polishing the removal rate (RR) was measured at 121 points on the diameter. The profile of removal rate of the whole workpiece polished with the polishing pad of Comparative Example 1 is shown in FIG. 3. The profiles of removal rate of the whole workpiece polished with the polishing pads of Example 1 and Example 2 are shown in FIGS. 9 and 11 respectively. Note that the removal rate (RR) was measured at a pitch of 2.5 mm within a radius of 140 mm and at a pitch of 1 mm outside a radius of 140 mm.

(Polishing Conditions)

Polishing machine: F-REX300 (manufactured by Ebara Corporation)

Temperature of polishing agent: 20° C.

Number of rotations (polishing surface plate): 70 rpm

Number of rotations (polishing head): 71 rpm

Polishing pressure: 3.5 psi

Polishing slurry: SS25 (trade name, manufactured by Cabot Microelectronics Corporation)

Flow rate of polishing slurry: 200 ml/min

Polishing time: 60 sec.

Workpiece: silicon wafer with TEOS (Tetra Ethyl Ortho Silicate)

The polishing results of polishing pads of Examples and Comparative Examples is shown in Table 3. Note that "the most edge ratio) of the polishing results were calculated by dividing the removal rate of the most edge parts (the part which is 149 mm from the center) of the workpiece by the average removal rate of the part which is between 100 and 140 mm from the center.

TABLE 3

| Polish results (Most edge ratio) | Example 1 | Example 2 | Example 3 | Example 4 | Example 5 | Example 6 | Comparative Example 1 | Comparative Example 2 |
|---|---|---|---|---|---|---|---|---|
| | 1.18 | 1.29 | 1.31 | 1.24 | 1.28 | 1.35 | 1.58 | 1.6 |

As shown in FIG. 3, FIG. 13 and Tables 2 and 3, in the polishing with the polishing pad of Comparative Example 1 having a large ratio (tan $\delta_{max100\text{-}1000}$/tan $\delta_{max1\text{-}10}$) of 1.364, the most edge ratio was 1.58 and large and edge sagging was observed. In the polishing with the polishing pad of Comparative Example 2 using the different polishing layer and the different cushion layer from Comparative Example 1, the ratio (tan $\delta_{max100\text{-}1000}$/tan $\delta_{max1\text{-}10}$) was 1.366 and large and edge sagging was observed like Comparative Example 1.

As shown in FIGS. 8 and 9 and Tables 2 and 3, in the polishing with the polishing pad of Example 1 having a small ratio (tan $\delta_{max100\text{-}1000}$/tan $\delta_{max1\text{-}10}$) of 0.995, the most edge ratio was 1.18 and restrained to 1.5 or less and edge sagging was prevented. In the polishing with the polishing pad of Example 2 using the cushion layer different from Example 1, the ratio (tan $\delta_{max100\text{-}1000}$/tan $\delta_{max1\text{-}10}$) was 0.893 and small and edge sagging was prevented like Example 1. Note that tan δ of the only polishing layer B used for the polishing pads of Examples 1 and 2 is shown in FIG. 12. The attitude of tan δ of the only polishing pad B was very different from that of the whole polishing shown in FIGS. 8 and 10. The most edge ratios of the polishing pads of Examples 3 to 6 using various polishing layers and/or cushion layers were not more than 1.5 by keeping the ratio (tan $\delta_{max100\text{-}1000}$/tan $\delta_{max1\text{-}10}$) within the prescribed range and edge sagging was prevented. The excellent edge profiles were obtained.

(Dynamic Viscoelasticity Measurement 2)

Figure 14:
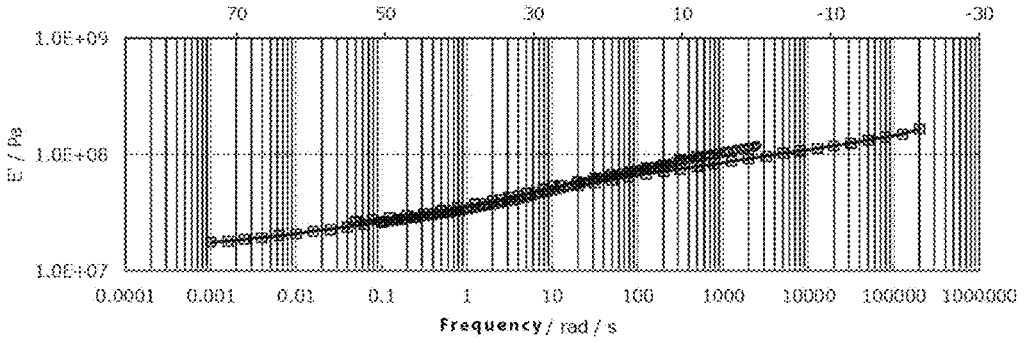
FIG. 14 is the graph of E' to the frequency when the dynamic viscoelasticity measurement of the whole polishing pad of Example 2 was performed in the bending mode.
Figure 15:
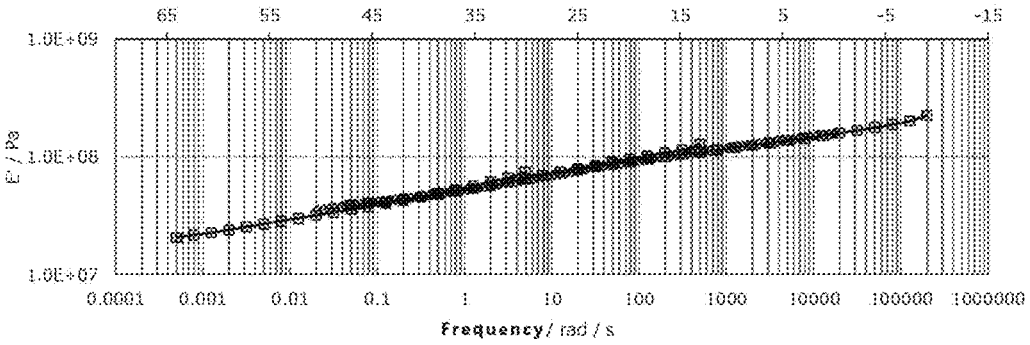
FIG. 15 is the graph of E' to the frequency when the dynamic viscoelasticity measurement of the whole polishing pad of Example 4 was performed in the bending mode.
Figure 16:
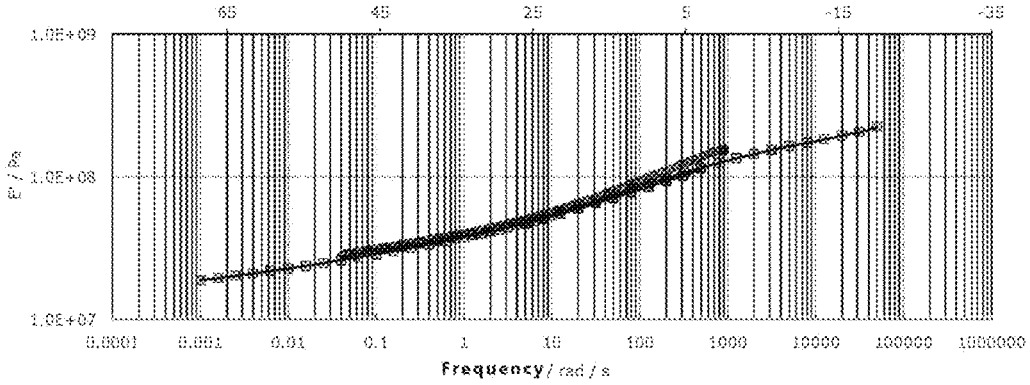
FIG. 16 is the graph of E' to the frequency when the dynamic viscoelasticity measurement of the whole polishing pad of Comparative Example 2 was performed in the bending mode.

Under the same conditions as the dynamic viscoelasticity measurement 1, the measurement was performed at temperatures of 5° C., 25° C. and 45° C. using the frequency dispersion. The measurement graph was synthesized by using the temperature-frequency conversion rule and the storage elastic modulus E' was obtained from 0.001 to 100000 rad/s. The measurement results of each of Examples and Comparative Examples are shown in Table 4. The overall results of the storage elastic modulus E' based on the frequency of Example 2 are shown in FIG. 14, the overall results of Example 4 are shown in FIG. 15 and the overall results of Comparative Example 2 are shown in FIG. 16, representatively.

TABLE 4

| | Example 1 | Example 2 | Example 3 | Example 4 | Example 5 | Example 6 | Comparative Example 1 | Comparative Example 2 |
|---|---|---|---|---|---|---|---|---|
| $E'_{10}$ | 54.4 | 51.9 | 58.8 | 36.7 | 70.1 | 28.4 | 37.6 | 53.9 |
| $E'_{1000}$ | 98.3 | 78.8 | 92.9 | 61.5 | 112.4 | 42.8 | 81.4 | 135.1 |
| Ratio ($E'_{1000}/E'_{10}$) | 1.81 | 1.52 | 1.58 | 1.68 | 1.60 | 1.51 | 2.16 | 2.51 |
| Step Elimination Performance | ○ | ○ | ○ | ○ | ○ | ○ | x | x |

(Step Polishing Amount Test (Step Elimination Performance Test))

The polishing pads of Examples and Comparative Examples were set at the prescribed position of the polishing apparatus through the double-sided tape having the acryl adhesive and the polishing was performed under the polishing conditions described above. The step elimination performance was evaluated by measuring the dishing of 100 μm/100 μm by the step/surface roughness/fine shape measuring apparatus (P-16+OF manufactured by KLA Corporation). The results were shown in FIGS. 17 to 20. Note that the dishing is the phenomenon that the wiring cross section is depressed in a dish-like shape mainly when the workpiece having the wide wiring pattern is polished. The erosion is the phenomenon that the insulating film is also shaved together with the wiring mainly at the fine wiring part. Both are the phenomenon that the workpiece is polished excessively.

The pattern wafer having a step of about 3000 to about 3500 angstroms was polished with the removal rate adjusted so that the polishing amount at one time was 1000 angstroms. Polishing was performed stepwise and the step of the wafer was measured every time. "Step Height" of the vertical axis in the figures shows the step.

Figure 17:
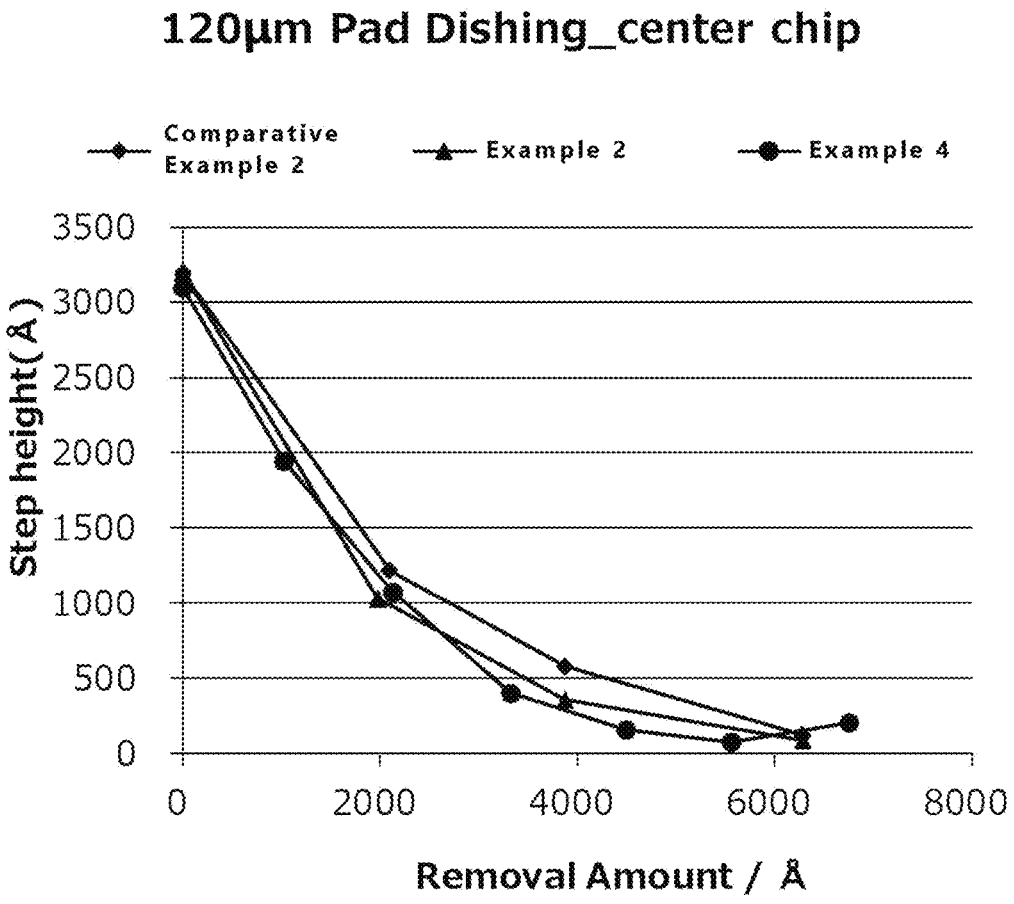
FIG. 17 shows the results when the step elimination performance tests were performed for the polishing pads of Example 2, Example 4 and Comparative Example 2 (when the workpiece has the Cu wiring having a width of 120 μm).
Figure 18:
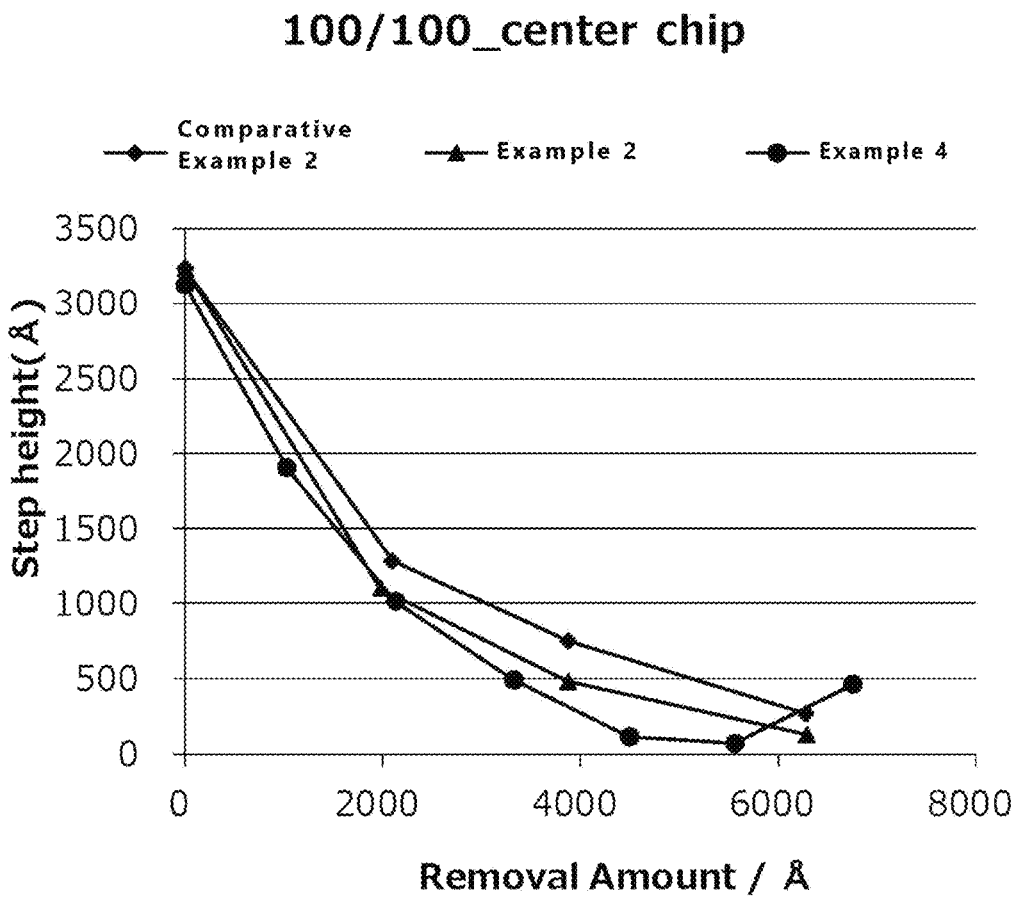
FIG. 18 shows the results when the step elimination performance tests were performed for the polishing pads of Example 2, Example 4 and Comparative Example 2 (when the workpiece has a Cu wiring having a width of 100 μm and an insulating film having a width of 100 μm).
Figure 19:
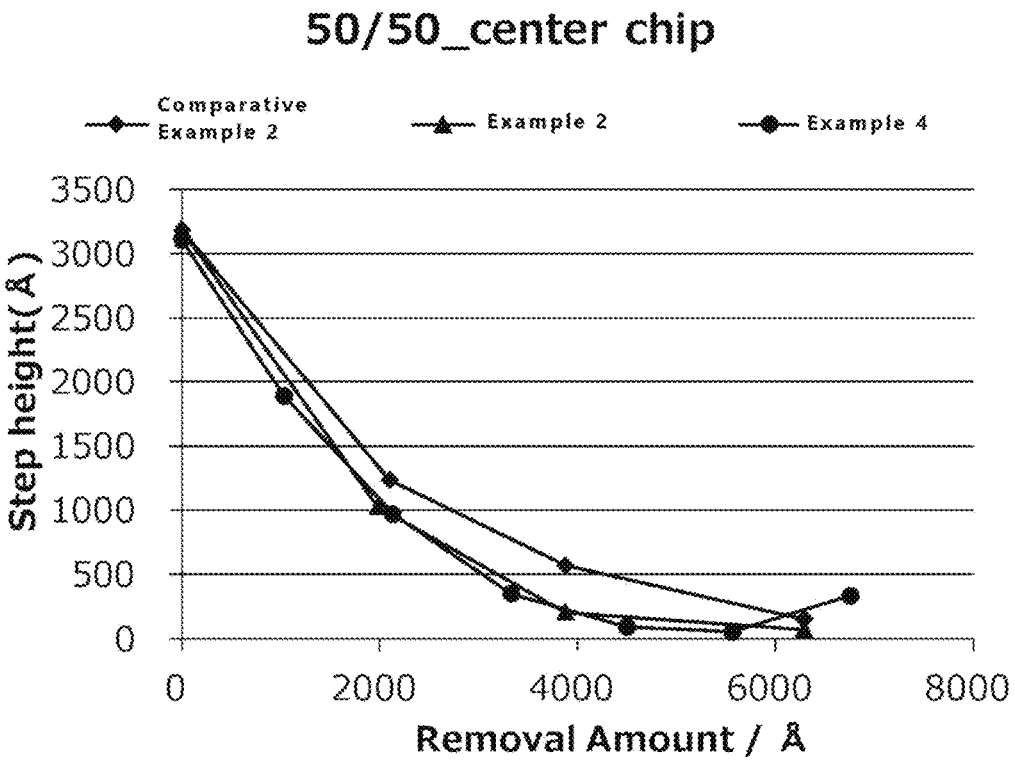
FIG. 19 shows the results when the step elimination performance tests were performed for the polishing pads of Example 2, Example 4 and Comparative Example 2 (when the workpiece has a Cu wiring having a width of 50 μm and an insulating film having a width of 50 μm).
Figure 20:
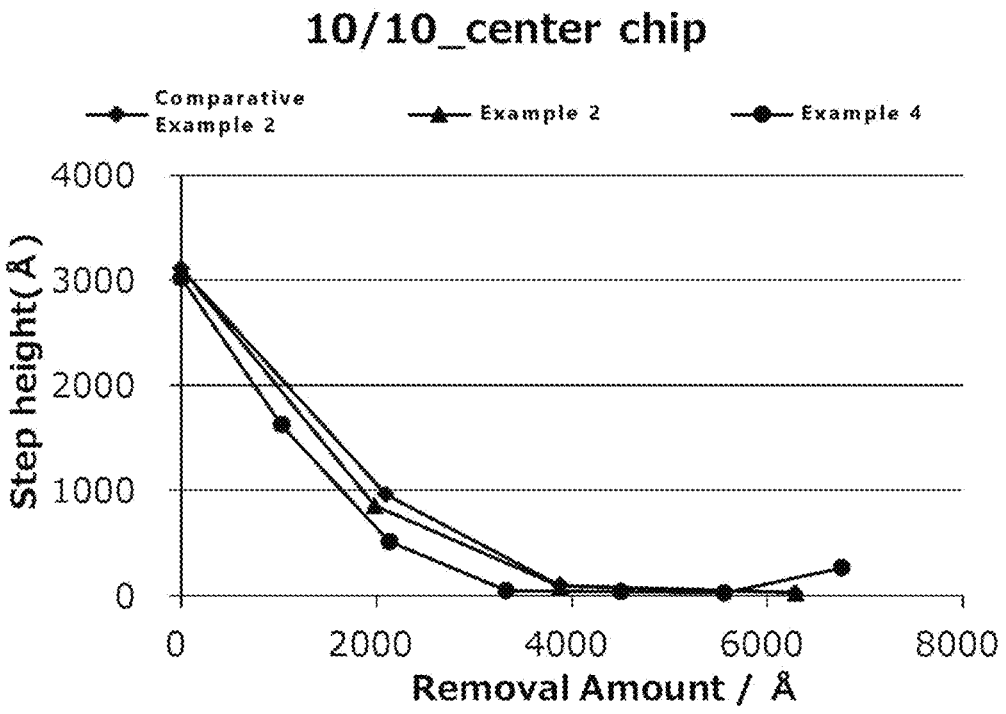
FIG. 20 shows the results when the step elimination performance tests are performed for the polishing pads of Example 2, Example 4 and Comparative Example 2 (when the workpiece has a Cu wiring having a width of 10 μm and an insulating film having a width of 10 μm).

The results of the step polishing test of the workpiece with the wiring having a width of 120 μm are shown in FIG. 17. The results of the step polishing test of the workpiece which has the Cu wiring having a width of 100 μm and the insulating film having a width of 100 μm are shown in FIG. 18. The results of the step polishing test of the workpiece which has the Cu wiring having a width of 50 μm and the insulating film having a width of 50 μm are shown in FIG. 19. The results of the step polishing test of the workpiece which has the Cu wiring having a width of 10 μm and the insulating film having a width of 10 μm are shown in FIG. 20. The wiring width is smaller, the wiring is finer.

When the ratio of the step elimination amount (angstroms) to the polishing amount (angstroms) of all the pattern wafer having a wiring width of 10 to 120 μm was more than 1 in the early polishing stage that the polishing is conducted until the polishing amount of 2000 angstroms, the polishing pad was excellent in step elimination performance and indicated by "o" in Table 4 illustrated above. When the ratio of the step elimination amount (angstroms) to the polishing amount (angstroms) of any of the pattern wafer having a wiring width of 10 to 120 μm was not more than 1, the polishing pad was inferior in step elimination performance and indicated by "x" in Table 4 illustrated above. Note that the step elimination amount was a value obtained by taking the step measured at a certain time during polishing from the initial step before polishing (about 3000 to about 3500 angstroms).

(Polishing Conditions 2)

Polishing machine: F-REX300 (manufactured by Ebara Corporation)
Disk: A188 (manufactured by 3M Japan Limited)
Temperature of polishing agent: 20° C.
Number of rotations (polishing surface plate): 90 rpm
Number of rotations (polishing head): 81 rpm
Polishing pressure: 3.5 psi
Polishing slurry: CSL-9044C (the mixture mixed so that the weight ratio between the undiluted solution of CSL-9044C and water is 1:9 was used) (manufactured by FUJIMI INCORPORATED)
Flow rate of polishing slurry: 200 ml/min
Polishing time: 60 sec.
Workpiece: substrate with Cu film
Pad brake: 32 N 10 minutes
Conditioning: in-situ 18 N 16 scanning, Ex-situ 32 N 4 scanning

INDUSTRIAL APPLICABILITY

The present invention has the industrial applicability, because the present invention is to provide the polishing pad that enables an improvement in edge sagging and/or the step elimination performance and contributes manufacturing and the sales of the polishing pad.

DESCRIPTION OF CODE

1: Polishing Apparatus
3: Polishing Pad
4: Polishing Layer
4A: Hollow Microsphere
6: Cushion Layer
7: Adhesive Layer
8: Workpiece
8*a*: Edge Sagging
9: Slurry
10: Polishing Surface Plate
11: Base
12: Jig
16: Holding surface plate

The invention claimed is:

1. A polishing pad comprising:

a polishing layer having a polishing surface for polishing a workpiece; and a cushioning layer disposed on the opposite side of the polishing layer from the polishing surface, wherein with regard to a ratio tan δ of a storage elastic modulus E' to a loss elastic modulus E" of the polishing pad as obtained through a dynamic viscoelasticity measurement using a frequency dispersion at 25° C. in a bending mode, a ratio of a maximum value of tan δ measured at 100 to 1000 rad/s, which is tan $\delta_{max100\text{-}1000}$, to a maximum value of tan δ measured at 1 to 10 rad/s, which is tan $\delta_{max1\text{-}10}$, is 0.75 to 1.30.

2. The polishing pad according to claim 1, wherein the ratio of the maximum value of tan δ measured at 100 to 1000 rad/s to the maximum value of tan δ measured at 1 to 10 rad/s is 0.85 to 1.15.

3. The polishing pad according to claim 1, wherein a ratio of a maximum value to a minimum value of tan δ measured at 0.1 to 10000 rad/s, which is the maximum value tan $\delta_{max0.1\text{-}10000}$/the minimum value tan $\delta_{min0.1\text{-}10000}$, is 1 to 1.3.

4. The polishing pad according to claim 1, wherein a difference between a maximum value and a minimum value of tan δ measured at 0.1 to 10000 rad/s, which is the maximum value tan $\delta_{max0.1\text{-}10000}$−the minimum value tan $\delta_{min0.1\text{-}10000}$, is 0 to 1.0.

5. A polishing pad comprising:

a polishing layer having a polishing surface for polishing a workpiece; and a cushioning layer disposed on the opposite side of the polishing layer from the polishing surface, wherein with regard to a storage elastic modulus E' when a dynamic viscoelasticity measurement of the polishing pad is performed using a frequency dispersion at 25° C. in a bending mode, a ratio $E'_{1000}/E'_{10}$ is 1 to 2, $E'_{1000}$ is a value of E' measured at 1000 rad/s, and $E'_{10}$ is a value of E' measured at 10 rad/s.

6. The polishing pad according to claim 5, wherein the ratio $E'_{1000}/E'_{10}$ is 1.4 to 1.9.

7. The polishing pad according to claim 5, wherein the polishing layer is formed of a polyurethane resin containing hollow microspheres.

8. The polishing pad according to claim 5, wherein the cushion layer is at least one selected from a group consisting of an impregnated nonwoven fabric, a sponge material and a suede material.

9. The polishing pad according to claim 5, wherein in polishing a pattern wafer having a step, in an early stage of the polishing until a polishing amount of 2000 angstroms, a ratio of a step elimination amount on the order of angstroms to a polishing amount on the order of angstroms is more than 1, when the pattern wafer having a wiring width of 10 μm to 120 μm is polished.

* * * * *